US007871054B2

(12) United States Patent
Walters

(10) Patent No.: US 7,871,054 B2
(45) Date of Patent: Jan. 18, 2011

(54) BRICK FORMLINER APPARATUS

(75) Inventor: Marshall Gilbert Walters, Lehighton, PA (US)

(73) Assignee: Architectural Polymers, Inc., Palmerton, PA (US)

( * ) Notice: Subject to any disclaimer, the term of this patent is extended or adjusted under 35 U.S.C. 154(b) by 1286 days.

(21) Appl. No.: 11/099,347

(22) Filed: Apr. 5, 2005

(65) Prior Publication Data

US 2006/0091282 A1 May 4, 2006

Related U.S. Application Data

(60) Provisional application No. 60/650,934, filed on Feb. 8, 2005.

(51) Int. Cl.
*E04G 13/00* (2006.01)
*B22D 19/04* (2006.01)

(52) U.S. Cl. ..... 249/15; 249/96

(58) Field of Classification Search ..... 52/384, 52/385, 386, 387, 389; 249/15, 96
See application file for complete search history.

(56) References Cited

U.S. PATENT DOCUMENTS

| | | | | | |
|---|---|---|---|---|---|
| 448,856 | A | | 3/1891 | Graff | |
| 953,720 | A | | 4/1910 | Stoeser | |
| 1,809,504 | A | | 6/1931 | Carvel | |
| 2,114,710 | A | * | 4/1938 | Holcomb | 52/387 |
| 2,627,744 | A | * | 2/1953 | Lopina | 52/384 |
| 3,019,560 | A | * | 2/1962 | Hansen | 52/389 |
| 3,055,148 | A | | 9/1962 | Christy | |
| 3,602,476 | A | | 8/1971 | Iragorri | |
| 3,705,830 | A | | 12/1972 | Gurgui et al. | |
| 3,887,415 | A | | 6/1975 | Elmendorf et al. | |
| 3,899,155 | A | | 8/1975 | Ward | |
| 3,908,326 | A | * | 9/1975 | Francis | 52/384 |
| 4,135,840 | A | | 1/1979 | Puccini et al. | |
| 4,239,824 | A | | 12/1980 | Kasten | |
| 4,407,480 | A | | 10/1983 | Trimmer et al. | |

(Continued)

OTHER PUBLICATIONS

"Forming the Future," Fitzgerald Formliners, Santa Ana, California (http://www.formliners.com/FormlinerTypes/BrickMaster/Index.htm, as accessed on May 30, 2006).

(Continued)

*Primary Examiner*—Michael Safavi
(74) *Attorney, Agent, or Firm*—McNees Wallace & Nurick LLC

(57) ABSTRACT

The present invention is a formliner apparatus comprising a plurality of substantially planar layers. The formliner further comprises a plurality of ribs extending in a direction away from the substantially planar layers and defining a plurality of recesses within the formliner in conjunction with the substantially planar layers, each of the plurality of ribs extending to a preselected rib plane. The present invention further comprises at least one resilient ridge on each rib defining each recess, each at least one resilient ridge extending into an adjacent recess, wherein each substantially planar layer is substantially parallel with the rib plane and located a preselected variance depth distance from the rib plane, each variance depth distance for at least some of the substantially planar layers being preselected from a preselected variance depth distance range, wherein each preselected variance depth distance not being equal to every other variance depth distance.

19 Claims, 12 Drawing Sheets

U.S. PATENT DOCUMENTS

| | | | | | |
|---|---|---|---|---|---|
| 4,453,359 | A | | 6/1984 | Robinson | |
| 4,589,241 | A | * | 5/1986 | Volpenhein | 52/385 |
| 4,890,433 | A | * | 1/1990 | Funaki | 52/386 |
| 4,932,182 | A | * | 6/1990 | Thomasson | 52/387 |
| 5,009,387 | A | | 4/1991 | Scott et al. | |
| 5,268,137 | A | | 12/1993 | Scott et al. | |
| 5,386,963 | A | | 2/1995 | Nasvik et al. | |
| 5,501,049 | A | * | 3/1996 | Francis et al. | 52/387 |
| 5,536,557 | A | | 7/1996 | Nasvik et al. | |
| 5,632,922 | A | | 5/1997 | Nasvik et al. | |
| D380,139 | S | | 6/1997 | Scott et al. | |
| 6,041,567 | A | * | 3/2000 | Passeno | 249/96 |
| 6,164,037 | A | | 12/2000 | Passeno | |
| D448,856 | S | | 10/2001 | Boone | |
| 6,408,585 | B1 | | 6/2002 | Tajima | |
| 6,516,578 | B1 | * | 2/2003 | Hunsaker | 52/387 |
| D479,614 | S | | 9/2003 | Scott et al. | |
| 6,631,598 | B2 | * | 10/2003 | Raineri | 52/385 |
| 6,634,617 | B2 | | 10/2003 | Potvin | |

OTHER PUBLICATIONS

"Brick Gasket Liner," Scott System, Denver, Colorado (http://www.scottsystem.com/brickgaskets.htm, as accessed on May 30, 2006).

"Product Data FITZIT-M Liner," Universal brick systems, inc., Charlotte, Michigan, dated Jun. 2003 (http://www.bricksystems.com/fitmfeat.php, as accessed on May 30, 2006).

* cited by examiner

BRICK FORMLINER APPARATUS

CROSS-REFERENCE TO RELATED APPLICATIONS

This application claims the benefit of U.S. Provisional Application No. 60/650,934, filed Feb. 8, 2005, entitled "FORMLINER APPARATUS," which application is incorporated herein by reference in its entirety.

FIELD OF THE INVENTION

The present invention relates generally to formliners and, more particularly, to a brick formliner apparatus that uses substantially randomly positioned brick depths.

BACKGROUND OF THE INVENTION

Architectural designs for various types of construction, including buildings and bridges, call for the use of brick in the walls of buildings. Although of little structural importance in modern construction projects, brick walls continue to be used for decorative architectural purposes. However, making walls entirely of brick and mortar has become relatively expensive in recent years in comparison to poured concrete. One development that has reduced the cost of brick walls has been the use of decorative thin bricks, which are cast into concrete wall panels. Such decorative bricks are significantly thinner than normal bricks and therefore are significantly less expensive than normal bricks per square foot of wall coverage.

However, since decorative bricks cannot be made into a regular brick wall, a new type of technology was required. In order to cast the decorative bricks into the concrete walls, polymer brick formliners were developed, which have a plurality of brick-receiving recesses. The brick-receiving recesses are designed to hold the decorative bricks in place during the casting of concrete walls. The brick-receiving recesses are formed into the formliners in regular brick patterns, with each recess having the same depth distance, so as to create a clean and organized brick appearance in the final panel product. Such formliners are first placed on a surface capable of supporting the weight of the formliners, decorative bricks, and poured concrete. Decorative bricks are then placed into the formliners and concrete is cast on top of the decorative bricks and formliners.

Unfortunately, the clean and organized appearance of the final brick-lined concrete panel has resulted in an unforeseen aesthetic problem. The use of such formliners in the manufacture of buildings has resulted in a very consistent appearance in such look for such prefabricated wall sections. One purpose that drove the development of brick formliners was the creation of a wall that had the appearance of hand-laid brick, without the extra cost associated with hand-laid brick. Normally, the use of manual labor in the laying of brick walls results in a brick wall in which some bricks extend further out of the wall than other bricks, as a result of normal human imprecision in construction. However, the regularity and precision of the thin brick placement, which is the result of the use of such polymer brick formliners, has resulted in the mass production of brick lined concrete panels that appear as though they have been manufactured by a machine rather than built up by hand.

The general construction and function of formliner apparatuses are well known in the art. Such formliners include the formliner described in U.S. Pat. No. 3,602,476 to Iragorri, assigned to San-Vel Concrete Corporation, which is incorporated by reference herein in its entirety, the formliner described in U.S. Pat. No. 6,164,037 to Passeno, which is incorporated by reference herein in its entirety, and the formliner described in U.S. Pat. No. 6,041,567 to Passeno, which is incorporated by reference herein in its entirety.

Formliners are often used modularly, such that several formliners must be lined up end to end or top to bottom in order to hold sufficient numbers of bricks or other elements for a wall. The joints between such formliners are often simply planar joints butted next to one another. When cementitious material is applied to the surface of such joints, the cementitious material may flow through the planar joints, resulting in extra time and labor to clean up the cementitious material that flowed through the planar joints.

Formliners are often used with plywood backing, which is either cured into or glued into the main portion of the formliner. Such plywood is provided to add additional structural strength and stability to the formliner. However, such plywood may become dislodged during the use of the formliner, particularly if the formliner is used numerous times.

What is needed is a new type of formliner that can be used to manufacture a brick wall that has the appearance that it was built by hand, rather than manufactured with a brick formliner. What is also needed is a formliner that prevents the flow of cementitious material. What is also needed is a formliner that provides better structural stability. The present invention provides this advantage as well as other related advantages.

SUMMARY OF THE INVENTION

The present invention is a formliner apparatus comprising a plurality of substantially planar layers. The formliner further comprises a plurality of ribs extending in a direction away from the substantially planar layers and defining a plurality of recesses within the formliner in conjunction with the substantially planar layers, each of the plurality of ribs extending to a preselected rib plane. The present invention further comprises at least one resilient ridge on each rib defining each recess, each at least one resilient ridge extending into an adjacent recess, wherein each substantially planar layer is substantially parallel with the rib plane and located a preselected variance depth distance from the rib plane, each variance depth distance for at least some of the substantially planar layers being preselected from a preselected variance depth distance range, wherein each preselected variance depth distance is not equal to every other variance depth distance.

The present invention is also a formliner comprising a plurality of substantially planar layers. The present invention further comprises a plurality of ribs extending in a direction away from the substantially planar layers and defining a plurality of recesses within the formliner in conjunction with the substantially planar layers, each of the plurality of ribs extending to a preselected rib plane. The formliner further comprises at least one resilient ridge on each rib defining each recess, each at least one resilient ridge extending into an adjacent recess; wherein at least one pad is positioned in at least two of the recesses, each at least one pads comprising a pad surface, each pad surface being positioned a preselected pad variance distance from each substantially planar surface in the at least one of the recesses, each pad surface being located a preselected pad depth distance from each respective at least substantially planar surface, wherein each preselected pad variance depth distance is not equal to every other pad variance depth distance.

The present invention is also a formliner comprising a plurality of substantially planar layers. The formliner further comprises a plurality of ribs extending in a direction away from the substantially planar layers and defining a plurality of recesses within the formliner in conjunction with the at least substantially planar layers, each of the plurality of ribs extending to a preselected rib plane, at least one exterior rib being positioned at an exterior edge of a formliner, the at least one exterior rib having an exterior side and an interior side, the interior side facing one of the recesses, the exterior side facing away from the recesses. The formliner further comprises at least one internal resilient ridge on each rib defining each recess, each at least one internal resilient ridge extending into an adjacent recess. The formliner further comprises at least one external resilient ridge on the exterior side of the at least one exterior rib, the at least one external resilient ridge facing away from the recesses.

The present invention is also a formliner comprising a main portion, the main portion comprising a plurality of substantially planar layers, a plurality of ribs extending in a direction away from the substantially planar layers and defining a plurality of recesses within the formliner in conjunction with the substantially planar layers, each of the plurality of ribs extending to a preselected rib plane, and at least one resilient ridge on each rib defining each recess, each at least one resilient ridge extending into an adjacent recess. The formliner also comprises a backing portion, the backing portion comprising a body, wherein at least one notch is formed in a substantial portion of the body, wherein an extension of the main portion extends into the at least one notch.

An advantage of the present invention is that the depth distances of at least substantially planar recess surfaces are varied, providing a brick veneer wall manufactured with the formliner of the present invention with the appearance of hand laid brick.

Another advantage of the present invention is that a brick veneer wall manufactured with the formliner of the present invention has a substantially seamless appearance of cementitious material after application without subsequent clean-up operation.

Another advantage of the present invention is that a backing is more firmly attached to a main section of a formliner, reducing the chances that the backing will be dislodged during use.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
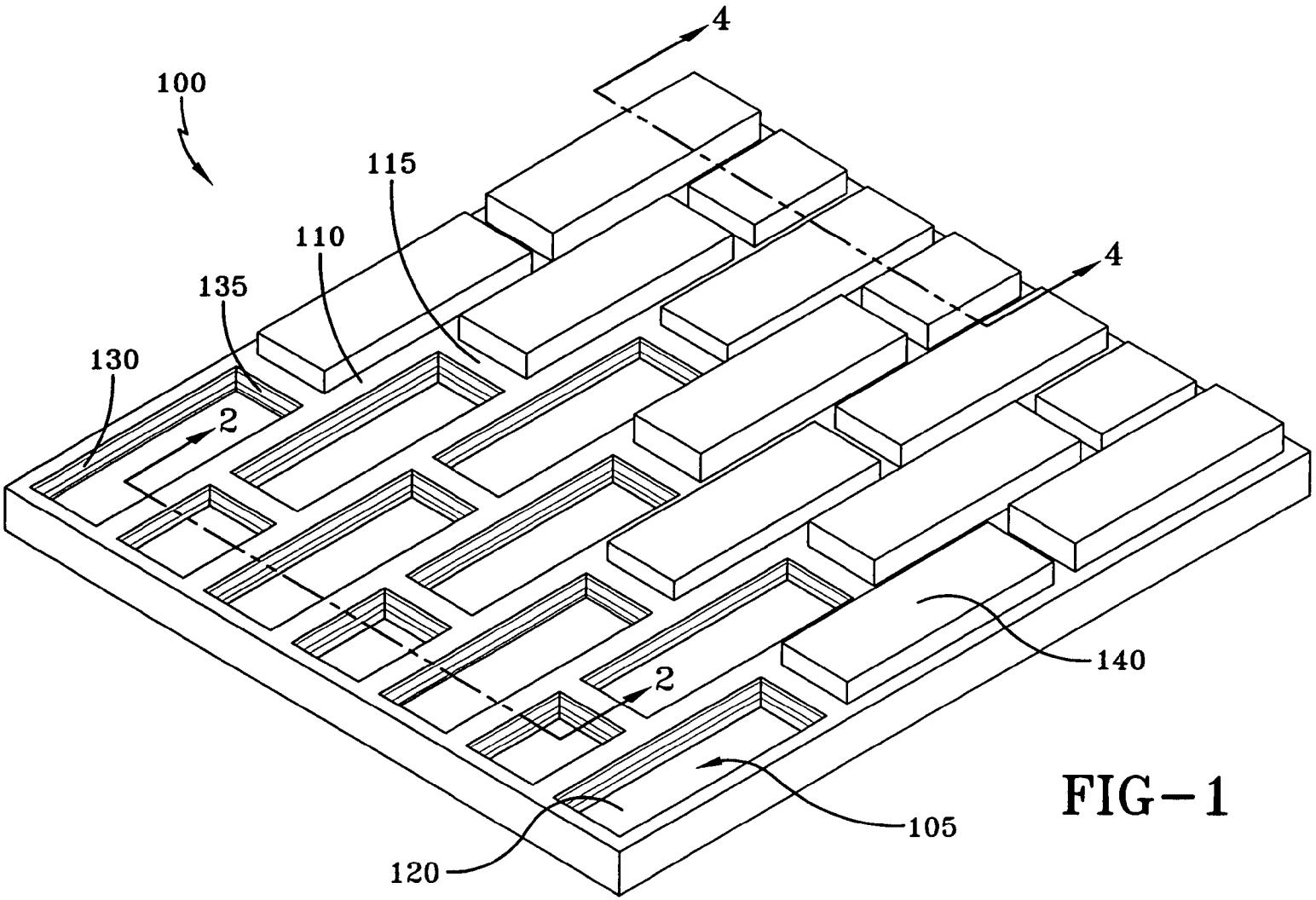
FIG. 1 is a perspective view of an embodiment of the formliner of the present invention with substantially random and at least substantially planar recess surface depth distances.

The present invention is a formliner apparatus, one embodiment of which is shown in FIG. 1. A brick formliner 100 is formed with a series of recesses 105, which are separated by and defined by lateral ribs 110 and interconnecting transverse ribs 115. The recesses 105 are shown in the figures in a brick running bond configuration, the configuration in which bricks are conventionally applied to walls. Such running bond configuration is only used to illustrate the features of the present invention and is not intended to limit the scope of the invention. Any other formliner configuration known in the art may also be used with the present invention, such as, for example flemish bond, basket weave, herringbone, etc. At the base of each recess 105 is an at least substantially planar recess surface 120. The lateral ribs 110 and transverse ribs 115 extend from the at least substantially planar recess surfaces 120 to a rib plane 125 (shown in FIG. 2). While the present invention is described using rectangular thin bricks 140, it should be understood that the present invention works with any shape or size of brick or other element to be assembled into a wall or other construction element.

The formliner 100 is preferably manufactured from an elastomeric material, such as rubber or any other resilient polymer of sufficient strength that it is compatible with cementitious material. In a preferred embodiment, the formliner comprises cured polymer made from liquid precursors. In a most preferred embodiment, the formliner comprises cured sulfide RTV liquid rubber made from two liquid precursors. The formliner 100 is molded and cured as known in the art.

The formliner embodiments described herein may have any functional dimensions as known in the art for formliners. While FIGS. 1-16 are not drawn to exact scale, these figures show the concepts set forth herein. For example, brick formliner 100 may be about 8 feet wide by 4 feet long by ⅜ inch deep.

Figure 2:
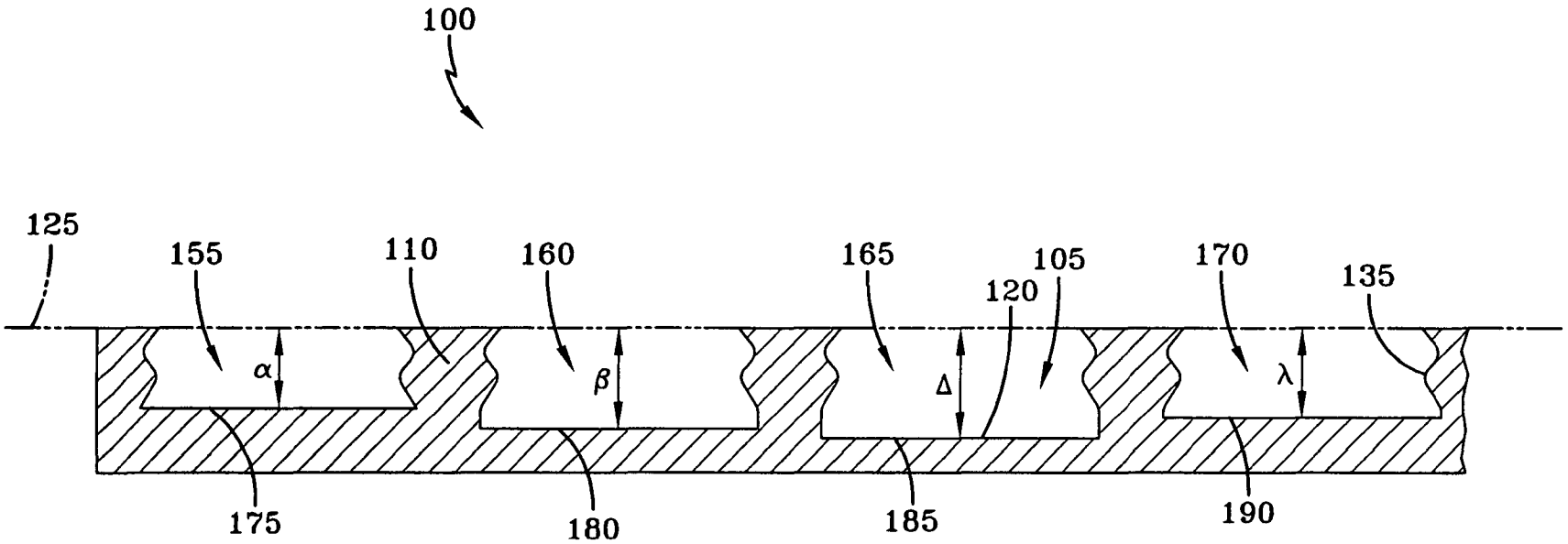
FIG. 2 is a cross-sectional view of the formliner of FIG. 1 taken along line 2-2.
Figure 3:
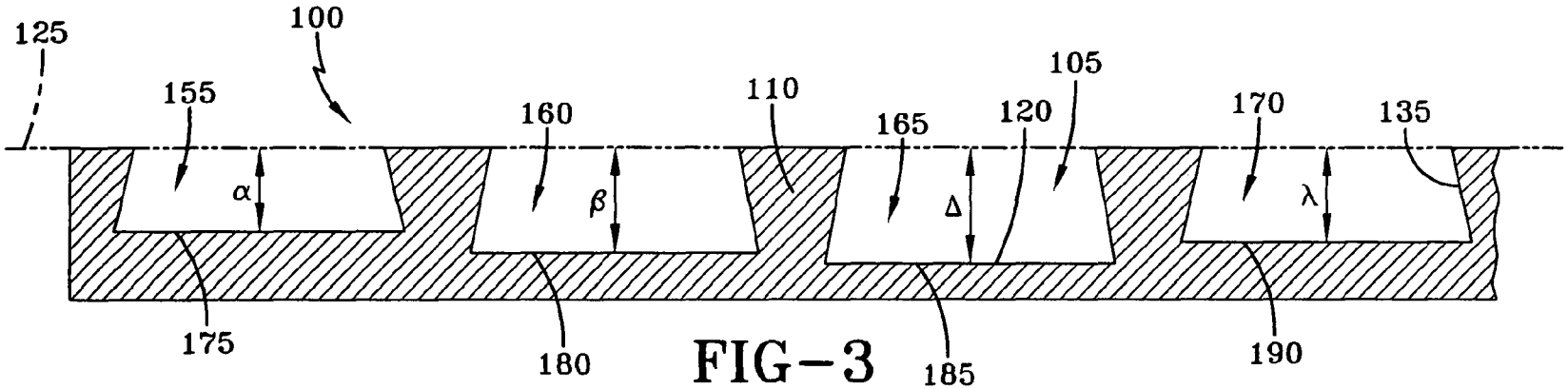
FIG. 3 is an alternate cross-sectional view of the formliner of the present invention taken along line 2-2.
Figure 4:
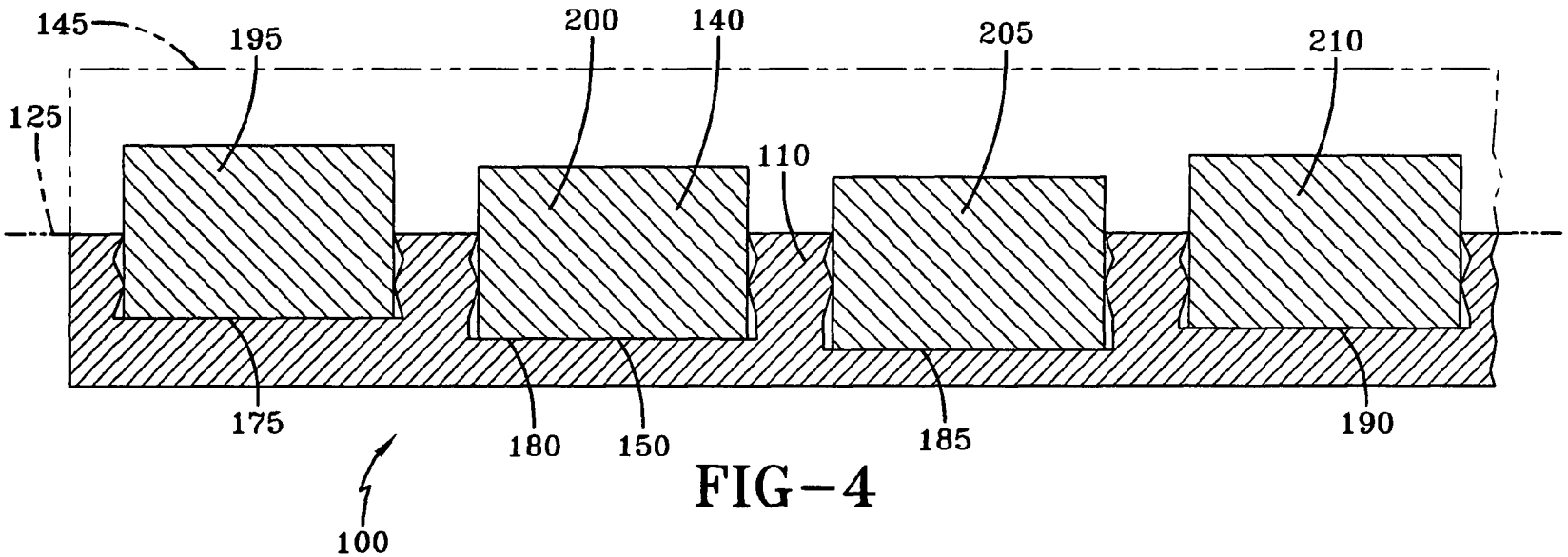
FIG. 4 is a cross-sectional view of the formliner of FIG. 1 with bricks disposed in the formliner recess taken along line 4-4.

Referring to FIGS. 1-4, each of the lateral ribs 110 is provided with at least one resilient protrusion or ridge 130, on every side of the lateral ribs facing a recess 105. The at least one ridge 130 extends from the lateral ribs 110 into the recesses 105. In addition, each of the transverse ribs 115 is provided with at least one resilient protrusion or ridge 135 on every side of the transverse ribs 115 facing a recess 105, which also extends from the lateral ribs 110 into the recesses 105. As known in the art, and as shown in FIG. 4, the at least one ridge 130, 135 engage and seal an adjacent surface of a brick 140 or other similar construction element, such as stone, tiles, stone slabs or other similar block elements, to prevent cementitious material 145, shown in phantom in FIG. 4, from flowing into the interior of the recess 105 and contacting the front faces 150 of the bricks 140 (or other element). Each brick 140 is snugly and sealingly received in each recess 105. Preferably, but optionally, the structure and number of the at least one lateral ridge 130 is substantially identical to the structure and number of the at least one transverse ridge 135. It is preferred that more than one lateral ridge 130 be present on each lateral rib 110 for each recess 105 and more than one transverse ridge 135 be present on each transverse rib 115 for each recess 105. For all embodiments set forth herein, in a preferred embodiment, the number of lateral ridges 130 for each lateral rib 110 for each recess 105 is in the range of from 1 to about 6 and the number of transverse ridges 135 for each transverse rib 115 for each recess 105 is in the range of from 1 to about 6. In a more preferred embodiment, the number of lateral ridges 130 for each lateral rib 110 for each recess 105 is in the range of from 1 to about 4 and the number of transverse ridges 135 for each transverse rib 115 for each recess 105 is in the range of 1 to about 4.

However, optionally, as shown in the alternate cross-section in FIG. 3, which is similar to the cross-section of FIG. 2, only one simple angular lateral ridge 130 extending from each lateral rib 110 and one simple angular transverse ridge 135 extending from each transverse rib 115 may be used for each recess 105. In such a simple angle configuration, the portion of the lateral ridge 130 which extends furthest into the recess 105, is located at the rib plane 125 and the portion of the lateral ridge 130, which extends the least into the recess 105, is located at the at least substantially planar recess surface 120.

As shown in FIGS. 1-4, each at least substantially planar layer recess surface 120 is preferably disposed at a substantially randomly preselected variance depth distance from the rib plane 125, such that every substantially randomly preselected variance depth distance is not identical to every other substantially randomly preselected variance depth distance. Each substantially random preselection described herein may be substantially randomly preselected by any means known in the art, for example, but not limited to a programmed random number generator on a computer. The substantially randomly preselected variance depth distance for each at least substantially planar recess surface 120 is substantially randomly preselected from a preselected variance depth distance range. The upper and lower limits of the preselected variance depth distance range are dependent upon the thickness of the brick 140 (or other element). The smallest value of the variance depth distance range cannot be too small or the brick 140 (or other construction element) will not be effectively sealed into the recess 105 by the at least one lateral resilient ridge 130 and the at least one transverse resilient ridge 135, which can result in cementitious material adhering to the front face 150 of the brick 140. The largest value of the variance depth distance range cannot be too large or the brick (or other construction element) will not extend far enough out beyond the rib plane 125 of the formliner 100 to effectively adhere into the cementitious material 145. For example, if thin brick 140 is selected for use with a particular formliner 100, and the thin brick 140 has profile outline dimensions of about 7½ inch long by about 3½ inch wide by about ½ inch thick, the variance depth distance range would be in the range of about ⅛ inch to about ¼ inch to achieve proper functioning of the formliner 100.

In a preferred embodiment, each variance depth distance is substantially randomly preselected from a preselected set of variance depth distances, the set of variance depth distances comprising a preselected number of discrete preselected variance depth distances. In a preferred embodiment, the number of variance depth distances in the set is in the range of from 2 to about 5. In a more preferred embodiment, the number of variance depth distances in the set is 4. Each variance depth distance is substantially randomly preselected such that every substantially randomly preselected variance depth distance from the set is not identical to every other substantially randomly preselected variance depth distance from the set. One exemplary embodiment is shown in FIG. 2 and FIG. 3, where the variance depth distance set includes four discrete variance depth distances, represented as $\alpha$, $\beta$, $\Delta$, and $\lambda$. In the embodiments shown in FIGS. 1-4, the largest depth distance is $\Delta$, the next largest depth distance is $\beta$, the next largest depth distance is $\lambda$, and the shortest depth distance is $\alpha$. For the use with thin brick 140 having dimensions of about 7½ inches long by about 3½ inch wide by about ½ inch thick, exemplary values for $\alpha$, $\beta$, $\Delta$, and $\lambda$ are about ⅛ inch, about 11/32 inch, about 9/32 inch, and about 9/16, inch respectively as such symbols are used herein.

A first recess 155 has a variance depth distance of $\alpha$, such that an at least substantially planar recess surface 175 is a depth distance of a from the rib plane 125. A second recess 160 has a variance depth distance of $\beta$, such that an at least substantially planar recess surface 180 is a depth distance of $\beta$ from the rib plane 125. A third recess 165 has a variance depth distance of $\Delta$, such that an at least substantially planar recess surface 185 is a depth distance of $\Delta$ from the rib plane 125. A fourth recess 170 has a variance depth distance of $\lambda$, such that an at least substantially planar recess surface 175 is a depth distance of $\lambda$ from the rib plane 125. Bricks 140 installed into the formliner 100 are shown in cross-section in FIG. 4. As in FIG. 2, FIG. 4 shows four separate recesses with bricks 140, each recess again having a variance depth distance, one each of $\alpha$, $\beta$, $\Delta$, and $\lambda$. Cementitious material 145 is shown in phantom. A first brick 195 is shown positioned against at least substantially planar recess surface 175, which is a depth distance $\alpha$ from the rib plane 125. A second brick 200 is shown positioned against at least substantially planar recess surface 180, which is a depth distance $\beta$ from the rib plane 125. A third brick 205 is shown positioned against at least substantially planar recess surface 185, which is a depth distance $\Delta$ from the rib plane 125. The fourth brick 210 is shown positioned against at least substantially planar recess surface 210, which is a depth distance $\lambda$ from the rib plane 125.

During normal construction, after the bricks 140, 195, 200, 205, 210 are installed in the formliner, cementitious material 145 is poured into a structure, or form as known in the art, against the formliner 100 and bricks 140, 195, 200, 205, 210 to create a wall or other structure with the appearance of a hand laid brick wall (or other structure). As the cementitious material 145 cures, the bricks 140, 195, 200, 205, 210 are sealed within against the cementitious material. Once the cementitious material has sufficiently cured to retain the bricks 140, 195, 200, 205, 210, the formliner 100 is removed from the cementitious material 145 and the bricks 140, 195, 200, 205, 210 leaving the bricks 140, 195, 200, 205, 210 set within the cementitious material 145.

As is evident from the cementitious material in phantom 145, once the formliner 100 is removed, the brick 205 that was positioned against the deepest at least substantially planar recess surface 185 extends the furthest out from the cementitious material 145 as measured from rib plane 125. The brick 200 that was positioned against the next deepest at least substantially planar recess surface 180 extends the next furthest out from the cementitious material 145 as measured from rib plane 125. The brick 210 that was positioned against the next deepest at least substantially planar recess surface 190 extends the next furthest out from the cementitious material 145 as measured from rib plane 125. The brick 195 that was positioned against the shallowest at least substantially planar recess surface 175 extends the least out from the cementitious material 145 as measured from rib plane 125. Such variance in the extensions of the bricks 140, 195, 200, 205, 210 out from the cementitious material 145 results in a wall (or other construction element) with the appearance of a hand-laid brick wall rather than the appearance of a brick veneer wall that was manufactured with a conventional formliner 100.

In another alternate embodiment of the present invention, each of the variance depth distances for each at least substantially planar recess surface is substantially randomly preselected from a set of variance depth distances, the set of variance depth distances comprising a preselected number of discrete preselected variance depth distances. In a preferred embodiment, the number of variance depth distances in the set is in the range of from 2 to about 5. In a more preferred embodiment, the number of variance depth distances in the set is 4. The preselected variance depth distances for each at least substantially planar recess surfaces are substantially randomly preselected from the set of variance depth distances such that each discrete variance depth distance in the set of variance depth distances is preselected for a substantially similar number of at least substantially planar recess surfaces as every other discrete variance depth distance.

In another alternate embodiment of the present invention, each of the variance depth distances for each at least substantially planar recess surface is substantially randomly preselected from a set of variance depth distances, the set of variance depth distances comprising a preselected number of discrete preselected variance depth distances. In a preferred embodiment, the number of variance depth distances in the set is in the range of from 2 to about 5. In a more preferred embodiment, the number of variance depth distances in the set is 4. The preselected variance depth distance for each at least substantially planar recess surface are substantially randomly preselected from the set of variance such that each discrete variance depth distance is used for at least one of the at least substantially planar recess surfaces.

In another alternate embodiment of the present invention, each variance depth distance for each at least substantially planar recess surfaces is non-randomly preselected from a preselected variance depth distance range so as to create the appearance of hand laid brick in the wall or other structure, such that each variance depth distance for each at least substantially planar recess surface is not identical to every other variance depth distance. In another alternate embodiment, each variance depth distance for each at least substantially planar recess surface is non-randomly preselected from a set of discrete preselected variance depth distances ranges so as to create the appearance of hand-laid brick in the wall or other structure, such that each discrete variance depth distance is used for at least one of the at least substantially planar recess surfaces. In a preferred embodiment, the number of variance depth distances in the set is in the range of from 2 to about 5. In a more preferred embodiment, the number of variance depth distances in the set is 4.

Figure 5:
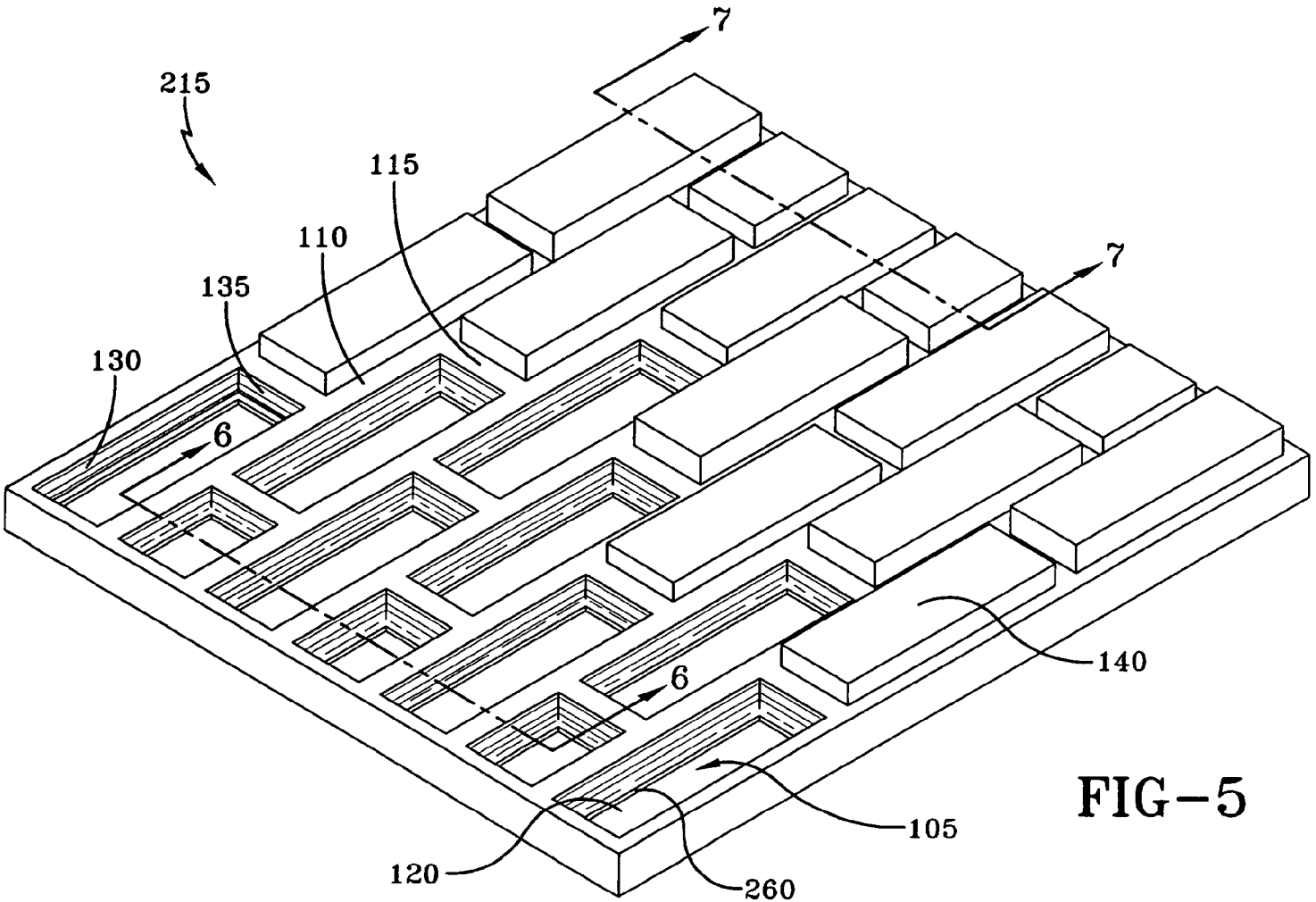
FIG. 5 is a perspective view of another embodiment of the formliner of the present invention with substantially random and at least substantially planar recess surface depth distances and pads.
Figure 6:
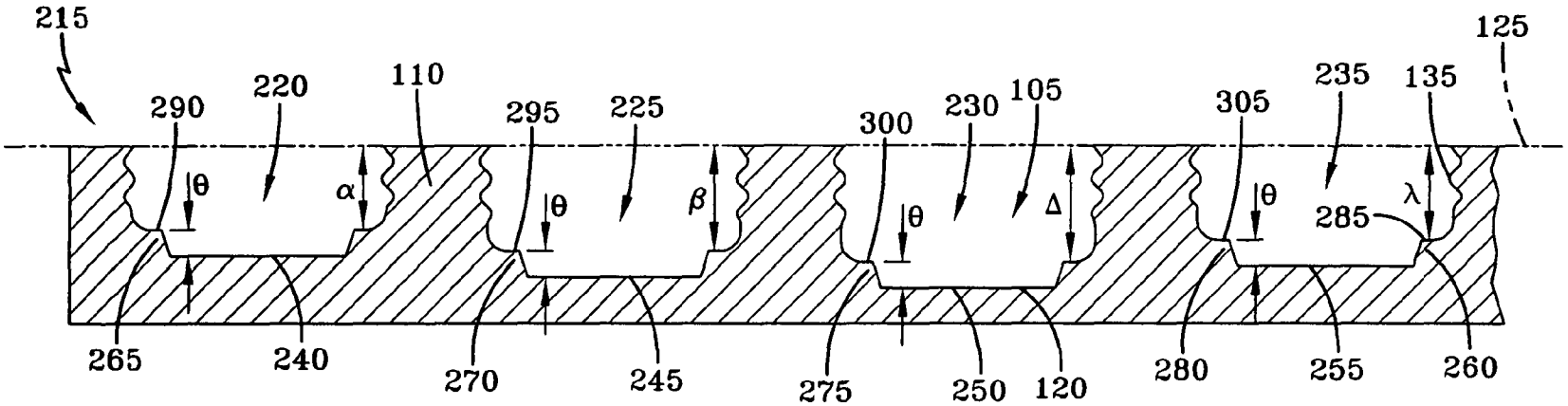
FIG. 6 is a cross-sectional view of the formliner of FIG. 5 taken along line 6-6.
Figure 7:
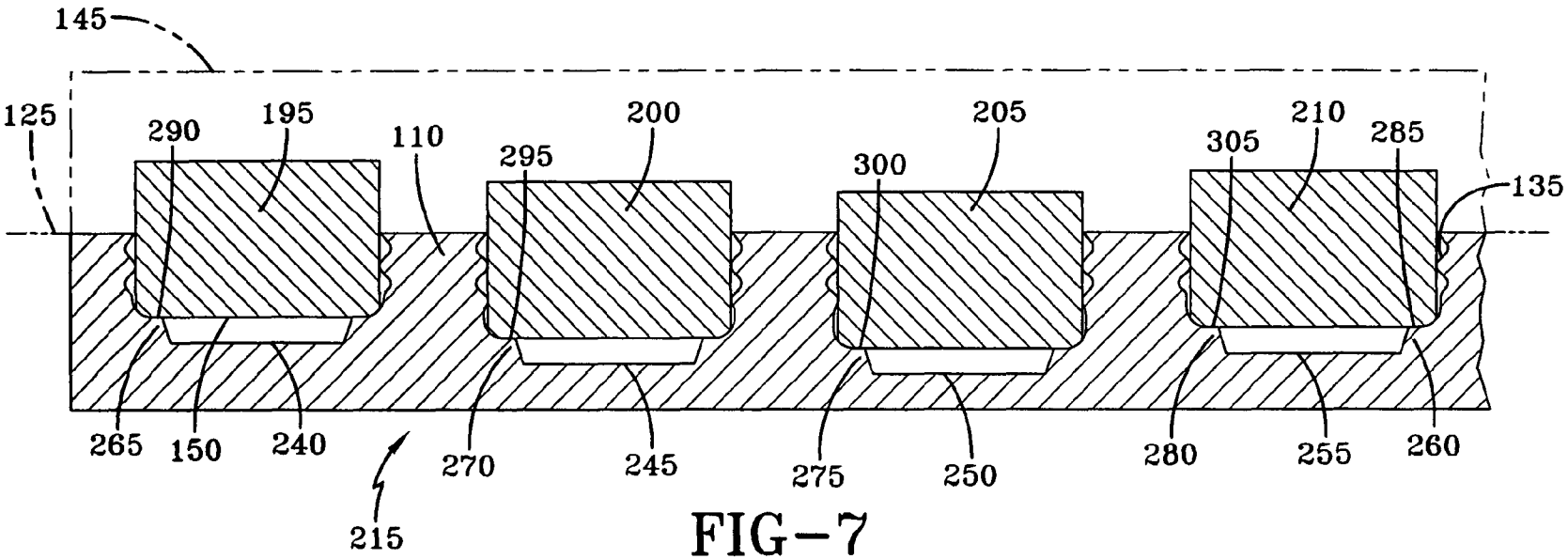
FIG. 7 is a cross-sectional view of the formliner of FIG. 5 with bricks disposed in the formliner recesses taken along line 7-7.

In an alternate embodiment of the present invention, as shown in FIGS. 5-7, a formliner 215 is shown with recesses 105, lateral ribs 110, transverse ribs 115, at least substantially planar recess surfaces 120, a rib plane 125, at least one lateral resilient ridge 135, and bricks 140 as described above for the embodiments shown in FIGS. 1-4. The formliner 215 also comprises at least one pad 260, positioned in each recess 105, each at least one pad 260 having a height of θ measured from where the at least one pad 260 meets the at least substantially planar recess surface 120 to the top of the at least one pad surface 285.

The formliner 215 is preferably manufactured from an elastomeric material, such as rubber or any other resilient polymer of sufficient strength that it is compatible with cementitious material. In a preferred embodiment, the formliner comprises cured polymer made from liquid precursors. In a most preferred embodiment, the formliner comprises cured sulfide RTV liquid rubber made from two liquid precursors. The formliner 215 is molded and cured as known in the art.

The formliner 215 is preferably manufactured from an elastomeric material, such as rubber or any other resilient polymer of sufficient strength that it is compatible with cementitious material. In a preferred embodiment, the formliner comprises cured polymer made from liquid precursors. In a most preferred embodiment, the formliner comprises cured sulfide RTV liquid rubber made from two liquid precursors. The formliner 215 is molded and cured as known in the art.

Each at least one pad 260 is preferably unitary with each at least substantially planar recess surface 120. Each pad 260 extends from each at least substantially planar surface 120 a preselected depth distance θ. The depth distance θ is dependent upon the size of the bricks. For example, for a brick 140 having dimensions of about 7½ inches long by about 3½ inch wide by about ½ inch thick, an exemplary value for θ is about ⅛ inch. In an alternate embodiment, each at least one pad 260 is made separately from the formliner 215 and is placed in each recess 105 and connected thereto.

Each at least one pad 260 may be of any functional geometry, as long as the at least one pad 260 is able to support the entire brick 140 and the superimposed cementitious material 145. FIGS. 5-7 illustrate one embodiment of the at least one pad 260, where the at least one pad 260 extends around the entire perimeter of each at least substantially planar recess surface 120. Any number of at least one pads 260 may be present in each recess 105 as desired. The use of the at least one pad 260 in each recess 105 reduces the total amount of material required for the formliner 215.

Each pad surface 285 is preferably a substantially randomly preselected pad variance depth distance from the rib plane 125, such that every substantially randomly preselected pad variance depth distance is not identical to every other substantially randomly preselected pad variance depth distance. The substantially randomly preselected pad variance depth distance for each pad surface 285 is substantially randomly preselected from a preselected pad variance depth distance range. The upper and lower limits of the preselected pad variance depth distance range are dependent upon the thickness of the brick 140 (or other element). As described above for the other embodiments, the smallest value of the pad variance depth distance range cannot be too small or the brick 140 (or other construction element) will not be effectively sealed into the recess 105 by the at least one lateral resilient ridge 130 and the at least one transverse resilient ridge 135, which can result in cementitious material 145 adhering to the front face 150 of the brick 140.

The largest value of the pad variance depth distance range cannot be too large or the brick (or other construction element) will not extend far enough out beyond the rib plane 125 of the formliner 215 to effectively adhere into the cementitious material 145. For example, if thin brick 140 is selected for use with a particular formliner 215, with the brick 140 having dimensions of about 7½ inch long by about 7½ inch wide by about ½ inch thick, the value of θ is about ⅛ inch being used in the formliner 215 of the present invention, the pad variance depth distance range would be in the range of about ¼ to about ⅛ to achieve proper functioning of the formliner 215.

In a preferred alternate embodiment, each pad variance depth distance is substantially randomly preselected from a preselected set of pad variance depth distances, the set of pad variance depth distances comprising a preselected number of discrete preselected pad variance depth distances. Each pad variance depth distance is substantially randomly preselected such that every substantially randomly preselected pad variance depth distance from the set is not identical to every other substantially randomly preselected pad variance depth distance from the set. In a preferred embodiment, the number of pad variance depth distances in the set is in the range of from about 2 to about 5. In a more preferred embodiment, the number of pad variance depth distances in the set is 4.

One exemplary embodiment is shown in FIGS. 5-7, where the pad variance depth distance set includes four pad discrete variance depth distances, represented as α, β, Δ, and λ. As in the previous embodiments, in the embodiments shown in FIG. 5-7, the largest depth distance is Δ, the next largest depth distance is β, the next largest depth distance is λ, and the shortest depth distance is α. FIG. 6 is a cross section of FIG. 5, showing four separate recesses without bricks, each recess having a different pad variance depth distance, one each of α, β, Δ, and λ.

A first recess 220 has a pad variance depth distance of α, such that a pad surface 290 of the at least one pad 265 is a depth distance of a from the rib plane 125. The at least substantially planar surface 240 is a depth distance of α plus θ from the rib plane 125. A second recess 225 has a pad variance depth distance of β, such that a pad surface 295 of the at least one pad 270 is a depth distance of β from the rib plane 125. The at least substantially planar surface 245 is a depth distance of β plus θ from the rib plane 125. A third recess 230 has a pad variance depth distance of Δ, such that a pad surface 300 of the at least one pad 275 is a depth distance of Δfrom the rib plane 125. The at least substantially planar surface 250 is a depth distance of Δ plus θ from the rib plane 125. A fourth recess 235 has a pad variance depth distance of λ, such that a pad surface 305 of the at least one pad 280 is a depth distance of λ from the rib plane 125. The at least substantially planar surface 255 is a depth distance of λ plus θ from the rib plane 125.

Bricks 140 installed into the formliner 215 are shown in cross-section in FIG. 7 shows four separate recesses with bricks 140, each recess again having a pad variance depth distance, one each of α, β, Δ, and λ. Cementitious material 145 is shown in phantom. A first brick 195 is shown positioned against pad surface 290, which is a depth distance αfrom the rib plane 125. A second brick 200 is shown positioned against pad surface 295, which is a depth distance β from the rib plane 125. A third brick 205 is shown positioned against pad surface 300, which is a depth distance Δ from the rib plane 125. A fourth brick 210 is shown positioned against pad surface 305, which is a depth distance λfrom the rib plane 125.

During normal construction, after the bricks 140, 195, 200, 205, 210 are installed in the formliner 215, cementitious material 145 is poured into a structure, or form as known in the art, against the formliner 215 and bricks 140, 195, 200, 205, 210 to create a wall or other structure with the appearance of a hand laid brick wall (or other structure). As the cementitious material 145 cures, the bricks 140, 195, 200, 205, 210 are sealed within the cementitious material 145. Once the cementitious material 145 is sufficiently cured to retain the bricks 140, 195, 200, 205, 210, the formliner 215 is removed from the cementitious material 145 and the bricks 140, 195, 200, 205, 210 leaving the bricks 140 195, 200, 205, 210 set within the cementitious material 145.

As is evident from the cementitious material 145 shown in phantom in FIG. 7, once the formliner 215 is removed, the brick 205 that was positioned against the deepest pad surface 300 extends the furthest out from the cementitious material 145 as measured from rib plane 125. The brick 200 that was positioned against the next deepest pad surface 295 extends the next furthest out from the cementitious material 145 as measured from rib plane 125. The brick 210 that was positioned against the next deepest pad surface 305 extends the next furthest out from the cementitious material 145 as measured from rib plane 125. The brick 195 that was positioned against the shallowest pad surface 290 extends the least out from the cementitious material 145 as measured from rib plane 125. Such variance in the extensions of the bricks 140, 195, 200, 205, 210 out from the cementitious material 145 results in a wall (or other construction element) with the appearance of a hand-laid brick wall rather than the appearance of a brick wall that was manufactured with a conventional formliner.

Figure 8:
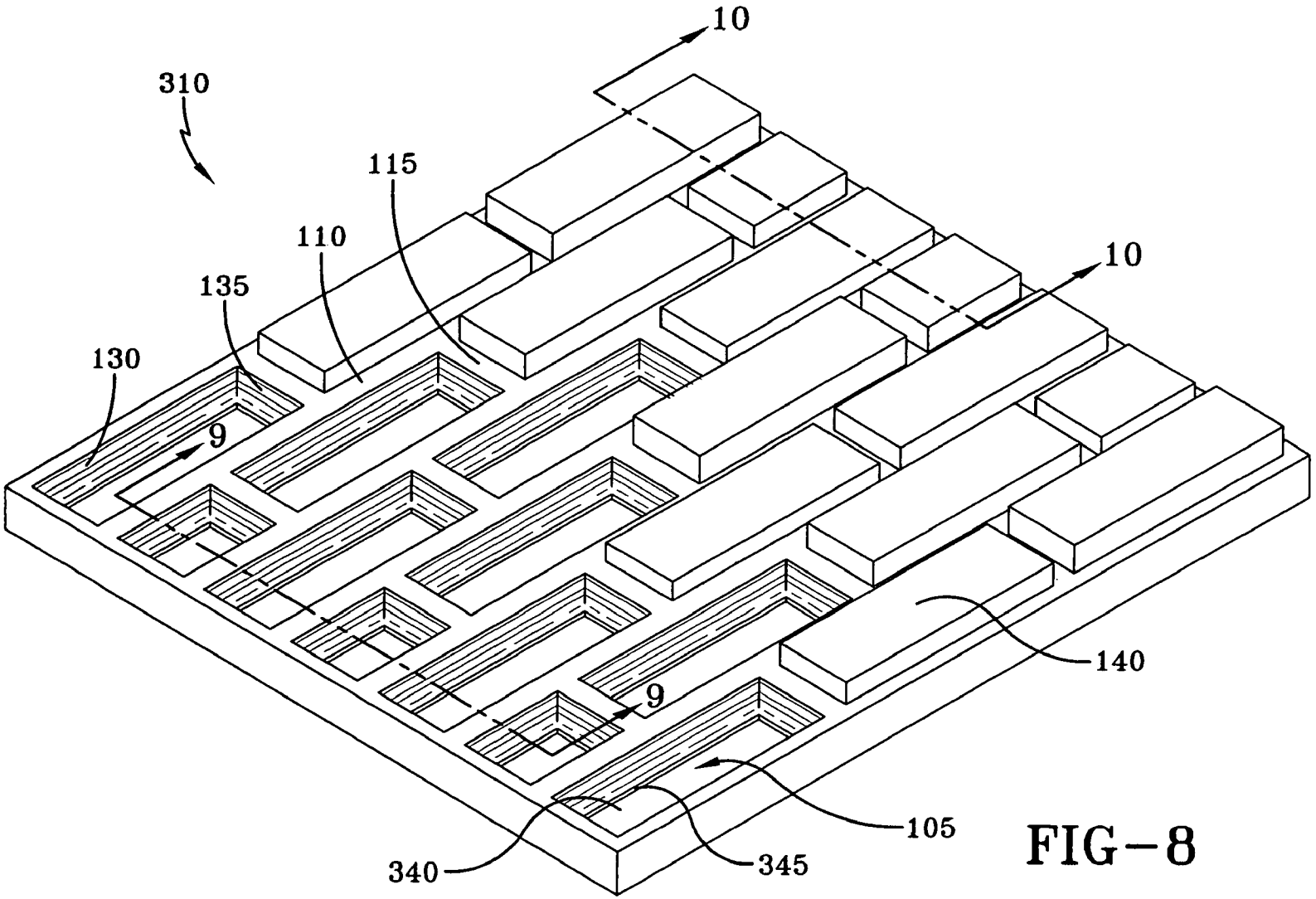
FIG. 8 is a perspective view of yet another embodiment of the formliner of the present invention with at least substantially planar recess surfaces with substantially random pad thicknesses.
Figure 9:
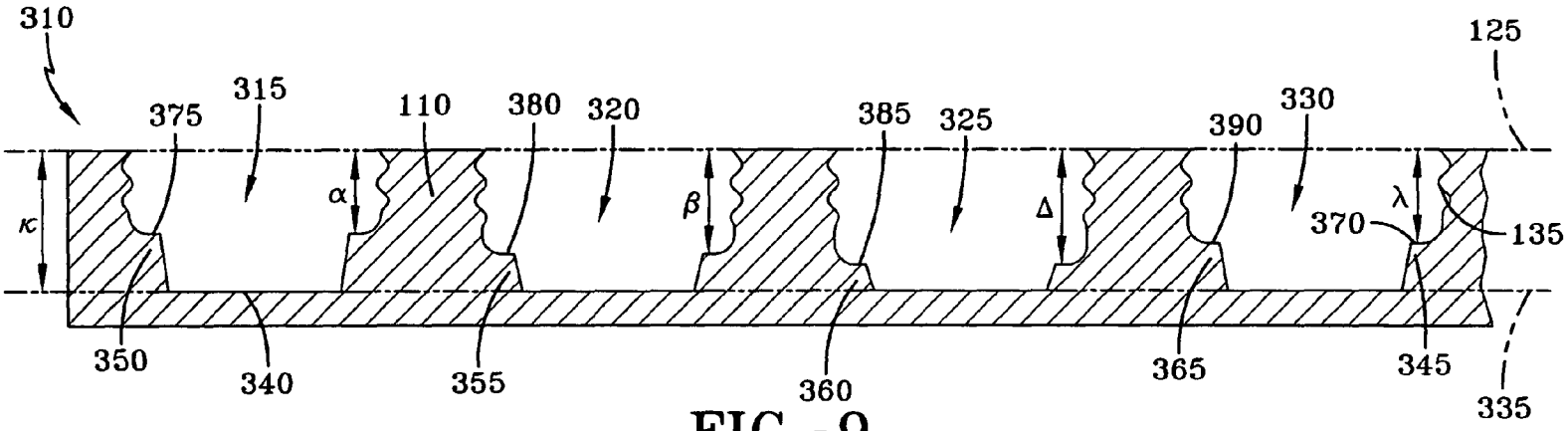
FIG. 9 is a cross-section view of the formliner of FIG. 8 taken along line 9-9.
Figure 10:
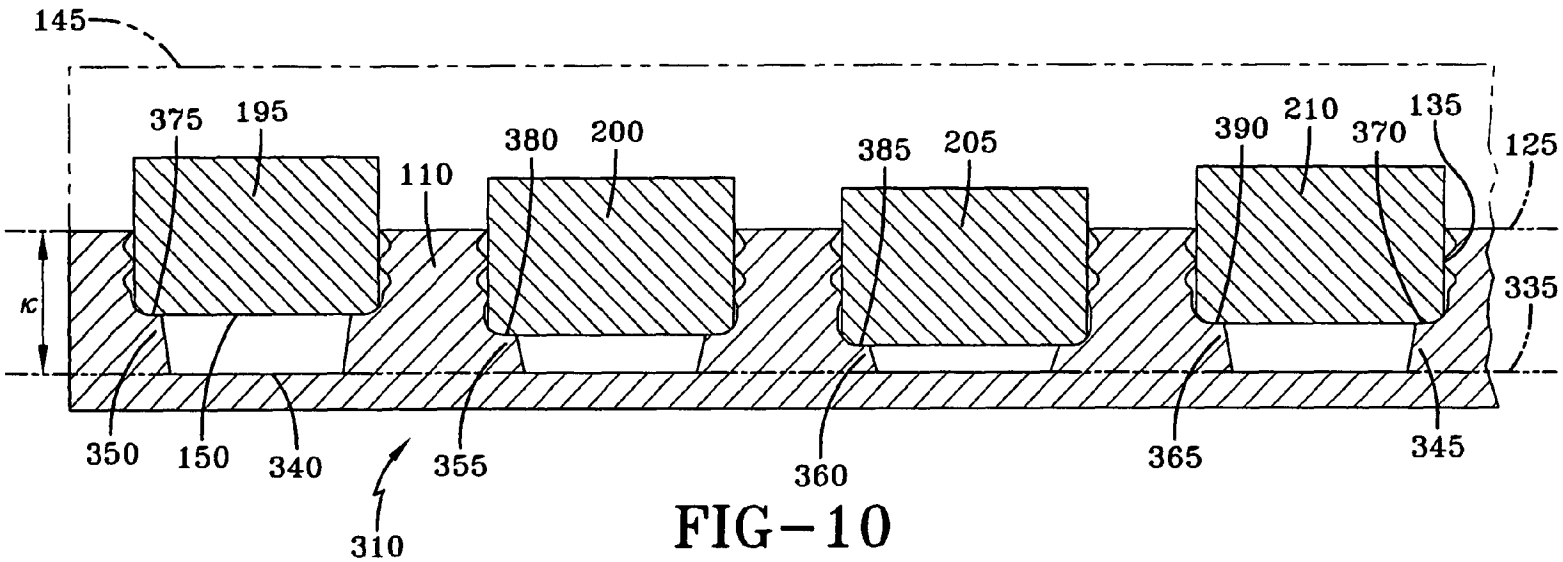
FIG. 10 is a cross-sectional view of the formliner of FIG. 8 with bricks disposed in the formliner recesses taken along line 10-10.

In another alternate embodiment of the present invention, as shown in FIGS. 8-10, a formliner 310 is shown with recesses 105, lateral ribs 110, transverse ribs 115, at least substantially planar recess surfaces 120, a rib plane 125, at least one lateral resilient ridge 135, and bricks 140 as described above for the embodiments shown in FIGS. 1-4. Each at least substantially planar recess surface 340 is at least substantially coextensive with a recess surface plane 335. Each recess surface plane 335 is positioned a preselected depth distance κ from the rib plane 125. Each recess 105 also contains at least one pad 345, each pad has a pad surface 370. For the use with brick 140 having dimensions of about 7½ inches long by about 3½ inch wide by about ½ inch thick, an exemplary values for κ is about ⅜ inch. For bricks 140 having different dimensions, the value of κ may be larger or smaller than about ⅜ inch, but is limited by the fact that κ may not be so large that the structural integrity of the formliner 310 is reduced to the point where the formliner 310 ceases to be functional.

The formliner 310 is preferably manufactured from an elastomeric material, such as rubber or any other resilient polymer of sufficient strength that it is compatible with cementitious material. In a preferred embodiment, the formliner comprises cured polymer made from liquid precursors. In a most preferred embodiment, the formliner comprises cured sulfide RTV liquid rubber made from two liquid precursors. The formliner 310 is molded and cured as known in the art.

Each at least one pad 345 is preferably unitary with each at least substantially planar recess surface 340. In an alternate embodiment, each at least one pad 345 is made separately from the formliner 310 and is placed in each recess 105 and connected thereto.

Each pad surface 370 is preferably a substantially randomly preselected pad variance depth distance from the rib plane 125, such that every substantially randomly preselected pad variance depth distance is not identical to every other substantially randomly preselected pad variance depth distance. The substantially randomly preselected pad variance depth distance for each pad surface 370 is substantially randomly preselected from a preselected pad variance depth distance range. The upper and lower limits of the preselected pad variance depth distance range are dependent upon the thickness of the brick 140 (or other element). As described above for the other embodiments, the smallest value of the pad variance depth distance range cannot be too small or the brick 140 (or other construction element) will not be effectively sealed into the recess 105 by the at least one lateral resilient ridge 130 and the at least one transverse resilient ridge 135, which can result in cementitious material adhering to the front face 150 of the brick 140.

The largest value of the pad variance depth distance range cannot be too large or the brick (or other construction element) will not extend far enough out beyond the rib plane 125 of the formliner 310 to effectively adhere into the cementitious material 145.

In a preferred alternate embodiment, each pad variance depth distance is substantially randomly preselected from a preselected set of pad variance depth distances, the set of pad variance depth distances comprising a preselected number of discrete preselected pad variance depth distances. In a preferred embodiment, the number of pad variance depth distances in the set is in the range of from 2 to about 5. In a more preferred embodiment, the number of pad variance depth distances in the set is 4. Each pad variance depth distance is substantially randomly preselected such that every substantially randomly preselected pad variance depth distance from the set is not identical to every other substantially randomly preselected pad variance depth distance from the set.

One exemplary embodiment is shown in FIGS. 8-10, where the pad variance depth distance set includes four discrete pad variance depth distances, represented as $\alpha$, $\beta$, $\Delta$, and $\lambda$. As in the previous embodiments, in the embodiments shown in FIG. 8-10, the largest depth distance is $\Delta$, the next largest depth distance is $\beta$, the next largest depth distance is $\lambda$, and the shortest depth distance is $\alpha$. FIG. 9 is a cross section of FIG. 8, showing four separate recesses without bricks, each recess having a different pad variance depth distance, one each of $\alpha$, $\beta$, $\Delta$, and $\lambda$.

A first recess 315 has a pad variance depth distance of $\alpha$, such that a pad surface 375 of at least one pad 350 is depth distance of a from the rib plane 125. The pad surface 375 is a depth distance of $\kappa$ minus $\alpha$ from recess surface plane 335. A second recess 320 has a pad variance depth distance of $\beta$, such that a pad surface 380 of the at least one pad 355 is a depth distance of $\beta$ from the rib plane 125. The pad surface 380 is a depth distance of $\kappa$ minus $\beta$ from the rib plane 125. A third recess 325 has a pad variance depth distance of $\Delta$, such that a pad surface 385 of the at least one pad 360 is depth distance of $\Delta$ from the rib plane 125. The pad surface 385 is a depth distance of $\kappa$ minus $\Delta$ from the rib plane 125. A fourth recess 330 has a pad variance depth distance of $\lambda$, such that a pad surface 390 of the at least one pad 365 is a depth distance of $\lambda$ from the rib plane 125. The pad surface 390 is a depth distance of $\kappa$ minus $\lambda$ from the rib plane 125.

Bricks 140 installed into the formliner 310 are shown in cross-section in FIG. 10. FIG. 10 shows four separate recesses with bricks 140, each recess again having a pad variance depth distance, one each of $\alpha$, $\beta$, $\Delta$, and $\lambda$. Cementitious material 145 is shown in phantom. The first brick 195 is shown positioned against pad surface 375, which is a depth distance $\alpha$ from the rib plane 125. The second brick 200 is shown positioned against pad surface 380, which is a depth distance $\beta$ from the rib plane 125. The third brick 205 is shown positioned against pad surface 385, which is a depth distance $\Delta$ from the rib plane 125. The fourth brick 210 is shown positioned against pad surface 390, which is a depth distance $\lambda$ from the rib plane 125.

During normal construction, after the bricks 140, 195, 200, 205, 210 are installed in the formliner 310, cementitious material 145 is poured into a structure, or form as known in the art, against the formliner 310 and bricks 140, 195, 200, 205, 210 to create a wall or other structure with the appearance of a hand laid brick wall (or other structure). As the cementitious material 145 cures, the bricks 140, 195, 200, 205, 210 are sealed within the cementitious material. Once the cementitious material is sufficiently cured to retain the bricks 140, 195, 200, 205, 210, the formliner 310 is removed from the cementitious material 145 and the bricks 140, 195, 200, 205, 210 leaving the bricks 140, 195, 200, 205, 210 set within the cementitious material 145.

As is evident from the cementitious material in phantom 145, once the formliner 310 is removed, the brick 205 that was positioned against the deepest pad surface 385 extends the furthest out from the cementitious material 145 as measured from rib plane 125. The brick 200 that was positioned against the next deepest pad surface 380 extends the next furthest out from the cementitious material 145 as measured from rib plane 125. The brick 210 that was positioned against the next deepest pad surface 390 extends the next furthest out from the cementitious material 145 as measured from rib plane 125. The brick 195 that was positioned against the shallowest pad surface 375 extends the least out from the cementitious material 145 as measured from rib plane 125. Such variance in the extensions of the bricks 140, 195, 200, 205, 210 out from the cementitious material 145 results in a wall (or other construction element) with the appearance of a hand-laid brick wall rather than the appearance of a brick veneer wall that was manufactured with a conventional formliner.

Figure 11:
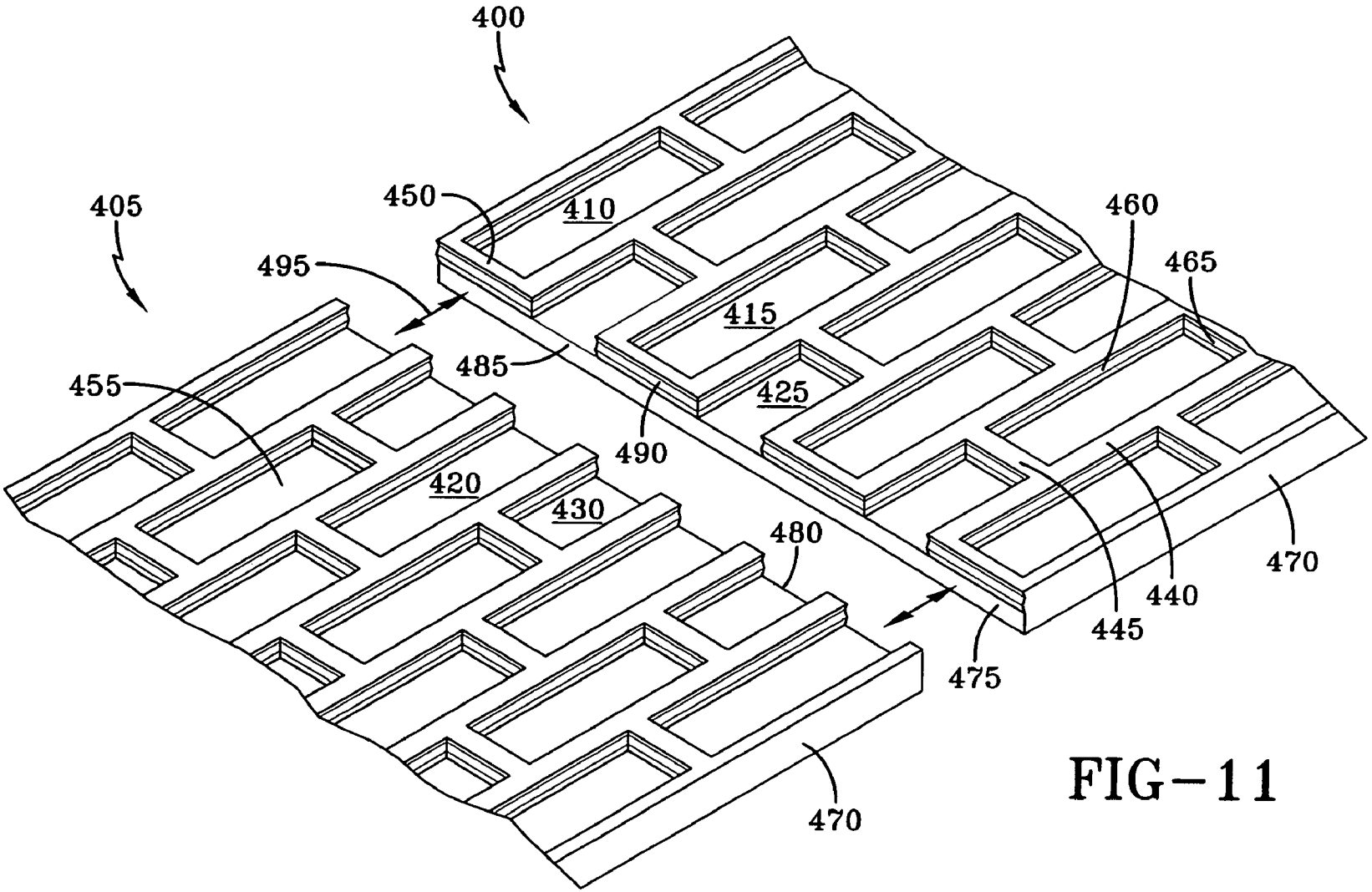
FIG. 11 is a perspective view of another embodiment of the formliners of the present invention showing two formliners at prior to forming a transverse joint.
Figure 12:
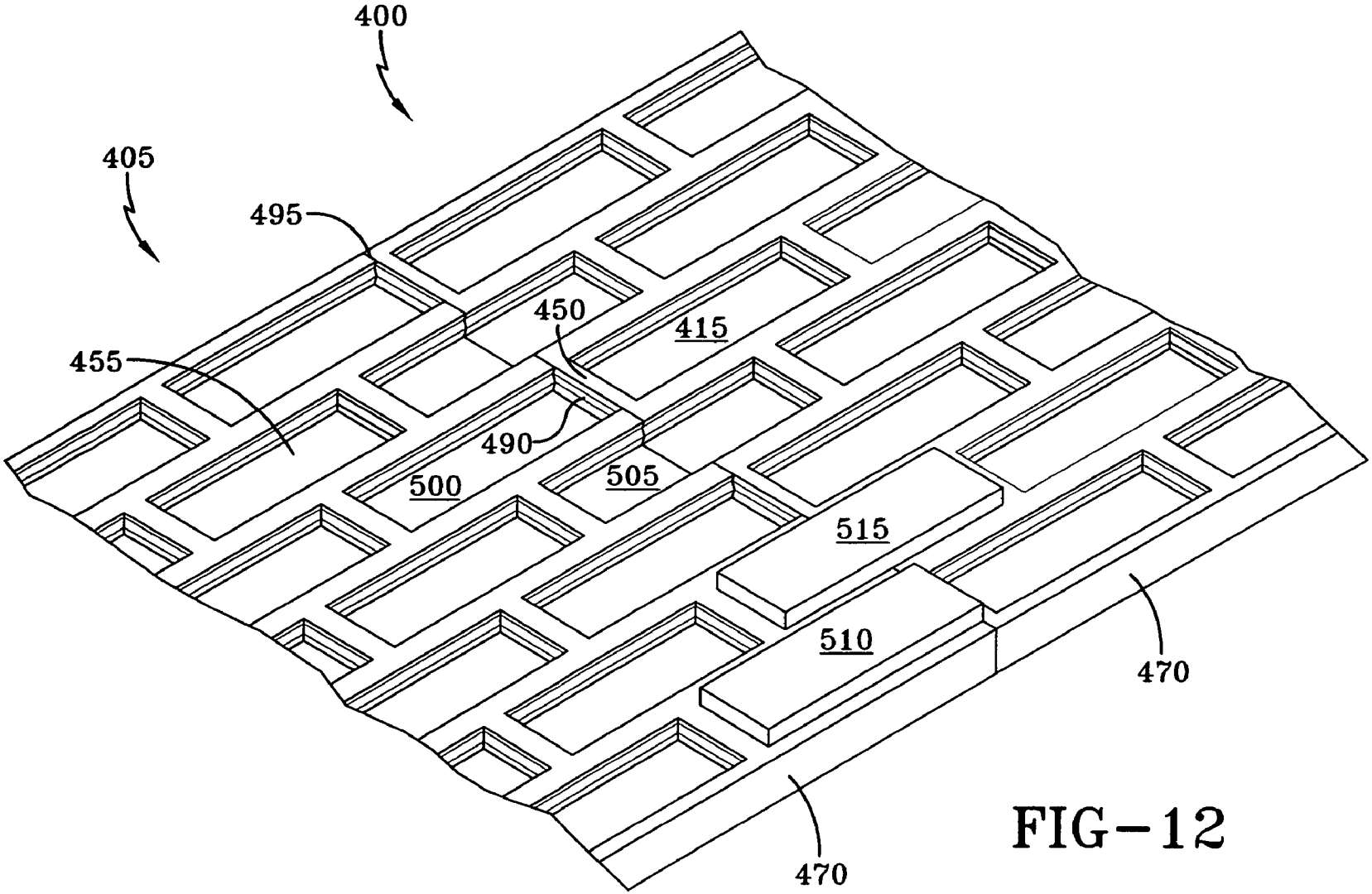
FIG. 12 is a perspective view of the formliners of FIG. 11 after forming the transverse joint.

Another embodiment of the formliners the present invention is shown in FIG. 11 and FIG. 12. Formliners are regularly modular in assembly, such that several formliners are butted up against one another and enclosed by a suitable framework in order to achieve the desired result. For example, if the formliners are produced such that they are 4' high by 8' long, but the length of a wall that is to be assembled using the formliner is 24' long, then three separate formliners would need to be laid side by side in order to achieve the 24' length. Ordinarily, it is desired to cast relatively large panels and a number of the templates are butted together When two formliners 400, 405 are assembled to lay side by side, a joint 495 is present between the two formliners. The present invention limits that amount of cementitious material that will flow between and/or through the formliners 400, 405 during use.

The formliners 400, 405 are preferably manufactured from an elastomeric material, such as rubber or any other resilient polymer of sufficient strength that it is compatible with cementitious material. In a preferred embodiment, the formliners comprise cured polymer made from liquid precursors. In a most preferred embodiment, the formliner comprise cured sulfide RTV liquid rubber made from two liquid precursors. The formliners 400, 405 are molded and cured as known in the art.

Two formliners 400, 405 are shown generally in a perspective view in FIG. 11 with their joint 495 exploded so that it can readily be seen how the two formliners 400, 405 are joined together during use. The formliners 400, 405 are formed with a series of recesses 410, which are separated by and defined by lateral ribs 440 and interconnecting transverse ribs 445, 450. Recesses 410, 415, 420, 425, 430 are shown in FIG. 11 and FIG. 12 in a brick running bond configuration. Such running bond configuration is only used to illustrate the features of the present invention and is not intended to limit the scope of the invention. Any other formliner configuration known in the art may also be used with the present invention, such as, for example flemish bond, basket weave, herringbone, etc. At the base of each recess 410, 415, 420, 425, 430 is an at least substantially planar recess surface 455. The lateral ribs 440 and transverse ribs 445, 450 extend from the at least substantially planar recess surfaces 455 to define the recesses 410.

Each of the lateral ribs 440 is provided with at least one resilient protrusion or ridge 460, on every side of the lateral ribs 440 facing a recess 410, 415, 420, 425, 430, which extends from the lateral ribs 440 into the recesses 410, 415, 420, 425, 430. In addition, each of the transverse ribs 445, 450 is provided with at least one protrusion or ridge 465, on every side of the transverse ribs 445, 450 facing a recess 410, 415, 420, 425, 430, which also extend from the transverse ribs 445, 450 into the recesses 410, 415, 420, 425, 430. These at least one resilient protrusions or ridges 460, 465 function as described above as for the at least one resilient protrusion or ridge 130, 135 for FIGS. 1-4. In a preferred embodiment, a plurality of resilient protrusions or ridges 460, 465 are present on every side of the lateral ribs 440 and transverse ribs 445, 450 facing a recess 410, 415, 420, 425, 430.

While the present invention is described using rectangular recesses 410, which are designed to receive rectangular bricks (or other construction elements), it should be understood that the present invention works with any shape or size of brick or other element to be assembled into a wall or other construction element. In normal wall construction, for which the running bond configuration is selected, most of the recesses are, or as explained further herein when the formliners 400, 405 are butted next to each other during use, become, enclosed full sized recesses, which are designed to receive a full sized brick (or other construction element). However, as is known in the art, some of the recesses at the end of the formliners will be enclosed half sized recesses to receive half sized bricks (or other elements).

Lateral exterior edges 470 and transverse exterior edges 475, 480 form the exterior boundaries of the formliners 400, 405 at and adjacent to the joint 495. The formliners 400, 405 are shown as generally in the form of a rectangular prism, but other shapes are also covered by the present invention, including more complex shapes that would be required due to complex building (or other structure) designs. The structure of the first formliner 400 at and adjacent to the transverse exterior edge 475 at the joint 495 is distinct from the structure of the second formliner 405 at and adjacent to the transverse exterior edge 480 at the joint 495.

The formliner 400, 405 structure at and adjacent to transverse exterior edges 475, 480 are configured so that the pattern of the recesses 410, shown in FIG. 11 and FIG. 12 as a running bond pattern, of the formliners 400, 405 is continuous across the joint 495 and so as to limit the flow of cementitious material through the joint 495 during the use of the formliners 400, 405. Such limitation of the flow of cementitious material through the joint 495 is accomplished through the specific configurations of the areas at and adjacent to the transverse exterior edges 475, 480.

As a function of the exemplary running bond configuration and the straight joint 495, the first formliner 400 has two types of recesses 415, 425 at and adjacent to the joint 495. The first type of recess 415 is a full sized recess, which is fully enclosed by lateral ribs 440 and transverse ribs 445, 450 including exterior transverse ribs 450 located at the joint 495. At the joint 495, the transverse ribs 450 have exterior edges 485, each of which have at least one exterior transverse resilient ridge 490, which extends away from the recess 415 which is enclosed, in part, by the exterior transverse rib 450. The second type of recess 425 is only partially enclosed by two lateral ribs 440 and one transverse rib 445 and is slightly more than half the size of a full sized recess 415. In a preferred embodiment, there are a plurality of exterior transverse resilient ridges 490.

The second formliner 405 also has two types of recesses at and near the joint 495. The first type of recess 420 is a full sized recess, but is only partially enclosed by two lateral ribs 440 and one transverse rib 445. The second type of recess 430 is also only partially enclosed by two lateral ribs 440 and one transverse rib 445 and is slightly less than half the size of a full sized recess 420, making the recess 430 smaller than the larger opposite recess 425.

As shown in FIG. 12, when the two formliners 400, 405 are butted next to one another during use, the formliners 400, 405 are aligned so that the exterior transverse ribs 450 of the first formliner 400 completes the enclosure of the first type of recesses 420 in the second formliner 405, creating a fully enclosed recess 500, which results in the at least one exterior transverse resilient ridge 495 serving as an at least one resilient ridge for the enclosed recess 500. The formliners 400, 405 are also aligned so that the second types of recesses 425, 430 matingly abut each other to create a fully enclosed full sized recess 505.

When bricks (or other elements) 510, 515 are installed as known in the art into the abutted formliners 400, 405 during use, the bricks are snugly and sealingly received by the recesses 500, 505 substantially the entire joint 495 is sealed against cementitious material passing through the joint 495. For exemplary purposes, only two bricks 510, 515 are shown, although during use all recesses would contain bricks (or other elements). For the portion of the joint 495 positioned at the location of the now fully enclosed recess 500, the at least one exterior transverse resilient ridge 490 acts as a seal against the brick present in a now fully enclosed recess 500, preventing the flow of cementitious material into and/or through that portion of the joint 495.

For the portion of the joint 495 located between the larger partial recess 425 of the first formliner 405 and the smaller partial recess 430 of the second formliner 405, a brick 515 itself overlaps the joint 495 in the now full sized recess 505, with the brick 515 sealing the portion of the joint 495 that runs through recess 505, preventing the flow of cementitious material into and/or through that portion of the joint 495. The prevention of such flow of cementitious material is important as it reduces and/or eliminates the excess cementitious material that otherwise covers the bricks (or other elements) after the formliners 400, 405 are removed from the wall or other structure. Such excess cementitious material must be cleaned off of the bricks in order to create a proper appearance, adding extra expense to the construction.

Figure 13:
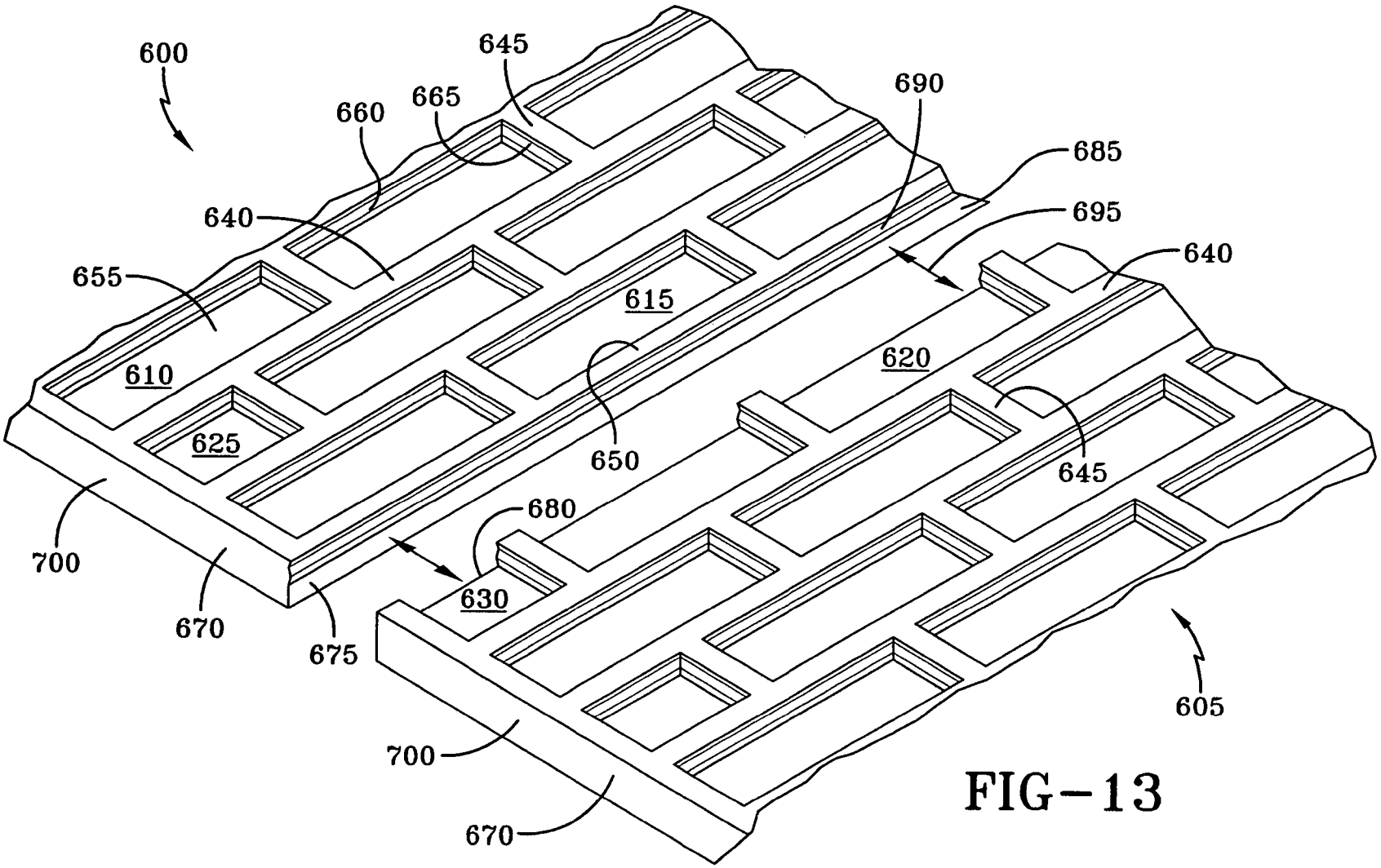
FIG. 13 is a perspective view of an embodiment of the formliners of the present invention showing two formliners prior to forming a lateral joint.
Figure 14:
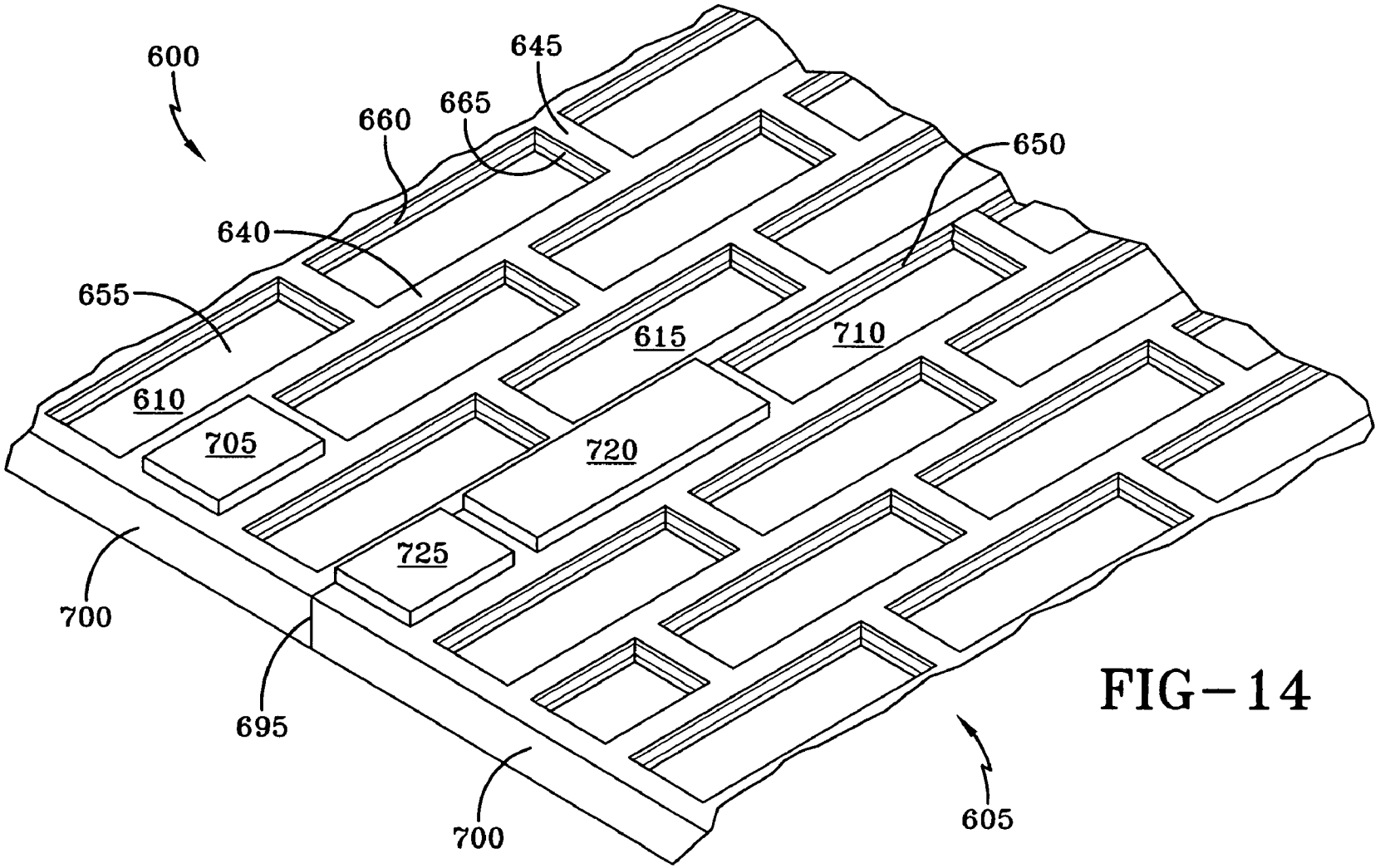
FIG. 14 is a perspective view of the formliners of FIG. 13 after forming the lateral joint.

Another embodiment of the formliners of the present invention is shown in FIG. 13 and FIG. 14. As mentioned above, formliners are regularly modular in assembly, such that several formliners are butted up against one another and enclosed by a suitable framework in order to achieve the desired result. For example, if the formliners are produced such that they are 4' high by 8' long, but the height of a wall that is to be assembled using the formliners is 12' high, then three separate formliners would need to be laid top to bottom to achieve the 12' height. Ordinarily, it is desired to cast relatively large panels and a number of the templates are butted together. When two formliners 600, 605 are assembled to lay top to bottom, a joint 695 is present between the two formliners. The present invention limits the amount of cementitious material that will flow between and/or through the formliners 600, 605 during use.

The formliners 600, 605 are preferably manufactured from an elastomeric material, such as rubber or any other resilient polymer of sufficient strength that it is compatible with cementitious material. In a preferred embodiment, the formliners comprise cured polymer made from liquid precursors. In a most preferred embodiment, the formliner comprise cured sulfide RTV liquid rubber made from two liquid precursors. The formliners 600, 605 are molded and cured as known in the art.

Two formliners 600, 605 are shown generally in a perspective view in FIG. 13 with their joint 695 exploded so that it can readily be seen how the two formliners 600, 605 are joined together during use. The formliners 600, 605 are formed with a series of recesses 610, 615, 620, 625, 630, which are separated by and defined by lateral ribs 640, 650 and interconnecting transverse ribs 645. The recesses 610, 615, 620, 625, 630 are shown in FIGS. 13 and 14 in a brick running bond configuration. Such running bond configuration is only used to illustrate the features of the present invention and is not intended to limit the scope of the invention. Any other formliner configuration known in the art may also be used with the present invention, such as, for example flemish bond, basket weave, herringbone, etc. At the base of each recess 610, 615, 620, 625, 630 is an at least substantially planar recess surface 655. The lateral ribs 640, 650 and transverse ribs 645 extend from the planar recess surfaces 655 to define the recesses 610, 615, 620, 625, 630.

Each of the lateral ribs 640 is provided with at least one resilient protrusion or ridge 660, on every side of the lateral ribs 640, 650 facing a recess 610, 615, 620, 625, 630, which extends from the lateral ribs 640, 650 into the recesses 610, 615, 620, 625, 630. In addition, each of the transverse ribs 645 is provided with one or more resilient protrusions or ridges 665, on every side of the transverse ribs 645 facing a recess 610, 615, 620, 625, 630, which also extend from the transverse ribs 645 into the recesses 610, 615, 620, 625, 630. These at least one resilient protrusions or ridges 660, 665 function as described above as for FIGS. 1-4. In a preferred embodiment, a plurality of resilient protrusions or ridges 665 are present on every side of the lateral ribs 640, 650 and transverse ribs 645 facing a recess 610, 615, 620, 625, 630.

While the present invention is described using rectangular recesses 610, 615, 620, 625, 630, which are designed to receive rectangular bricks 705, 720, 725 (or other construction elements), it should be understood that the present invention works with any shape or size of brick or other element to be assembled into a wall or other construction element. In normal wall construction, for which the running bond configuration is selected, most of the recesses are, or as explained further herein when the formliners 600, 605 are butted next to each other during use, become enclosed full sized recesses 710, which are designed to receive a full sized brick (or other construction element). However, as is known in the art, some of the recesses at the end of the formliners will be enclosed half sized recesses 625, 630 to receive half sized bricks 705, 725 (or other elements) as shown in FIG. 14.

Lateral exterior edges 675, 680 and transverse exterior edges 670 form the exterior boundaries of the formliners 600, 605 at and adjacent to the joint 695. The formliners 600, 605 are shown as generally in the form of a rectangular prism, but other shapes are also covered by the present invention, including more complex shapes that would be required due to complex building (or other structure) designs. The structure of the first formliner 600 at and adjacent to the lateral exterior edge 675 at the joint 695 is distinct from the structure of the second formliner 605 at and adjacent to the lateral exterior edge 680 at the joint 695.

The formliner 600, 605 structure at and adjacent to lateral exterior edges 675, 680 are configured so that the pattern of the recesses 610, 615, 620, 625, 630, shown in FIG. 13 and FIG. 14 as a running bond pattern, of the formliners 600, 605 is continuous across the joint 695 and so as to limit the flow of cementitious material through the joint 695 during the use of the formliners 600, 605. Such limitation of the flow of cementitious material through the joint 695 is accomplished through the specific configurations of the areas at and adjacent to the lateral exterior edges 675, 680.

As a function of the exemplary running bond configuration and the straight joint 695, the first formliner 600 has one type of recesses 615 at and adjacent to the joint 695. The first formliner also has another type of recess, namely a half-recess 625, but half-recess 625 is not located at the joint 695. The first type of recess 615 is a full sized recess, which is fully enclosed by lateral ribs 640, 650 and transverse ribs 645 including exterior lateral rib 650 located at the joint 695. At the joint 695, the lateral rib 650 has an exterior edge 675, and which at least one exterior transverse resilient ridge 690, which extends away from the recess 615 which are enclosed, in part, by the exterior lateral rib 650. In a preferred embodiment, there are a plurality of exterior transverse resilient ridges 690. In an alternate embodiment, there is one exterior transverse resilient ridge 690.

The second formliner 605 has two types of recesses at and near the joint 695. The first type of recess 620 is a full sized recess, but is only partially enclosed by two transverse ribs 645 and one lateral rib 640. The second type of recess 630 is also only partially enclosed by two transverse ribs 645 and one lateral rib 640 and is about half the size of a full sized recess 620.

As shown in FIG. 14, when the two formliners 600, 605 are butted next to one another during use, the formliners 600, 605 are aligned so that the exterior lateral rib 650 of the first formliner 600 completes the enclosure of the first and second types of recesses 620, 630 in the second formliner 605, creating fully enclosed recesses 710, which results in the at least one exterior lateral resilient ridge 690 serving as an at least one resilient ridge for the enclosed recesses 710.

When bricks (or other elements) 720, 725 are installed as known in the art into the abutted formliners 600, 605 during use, at least substantially the entire joint 695 is sealed against cementitious material passing through the joint 695. For exemplary purposes, only two bricks 720, 725 are shown at the joint 695, although during use all recesses would contain bricks (or other elements). For the portion of the joint 695 positioned at the location of the now fully enclosed recesses 710, the at least one exterior transverse resilient ridge 690 acts as a seal against the brick present in a now fully enclosed recess 700, preventing the flow of cementitious material into and/or through that portion of the joint 695. For the remaining portion of the joint 695, the at least one exterior lateral resilient ridge 690 acts as a seal against the lateral exterior edge 680.

The prevention of such flow of cementitious material is important as it reduces and/or eliminates the excess cementitious material that covers the bricks (or other elements) after the formliners 600, 605 are removed from the cured wall or other structure. Such excess cementitious material must be cleaned off of the bricks in order to create a proper appearance, adding extra expense to the construction.

The formliner set shown in FIG. 11 and FIG. 12 is exemplary for formliners where the joint 495 is positioned transversely. The formliner set shown in FIG. 13 and FIG. 14 is exemplary for formliners where the joint 695 is positioned laterally. As provided by the present invention, any formliner may contain both lateral joints 495 and transverse joints 695 as set forth in FIGS. 11-14, providing the ability to use multiple formliners to be used modularly together to create walls and other architectural objects having both significant heights and widths. Such formliners may combine the elements of exemplary formliners 400, 405, 600, and 605 described herein to achieve the desired architectural result.

Figure 15:
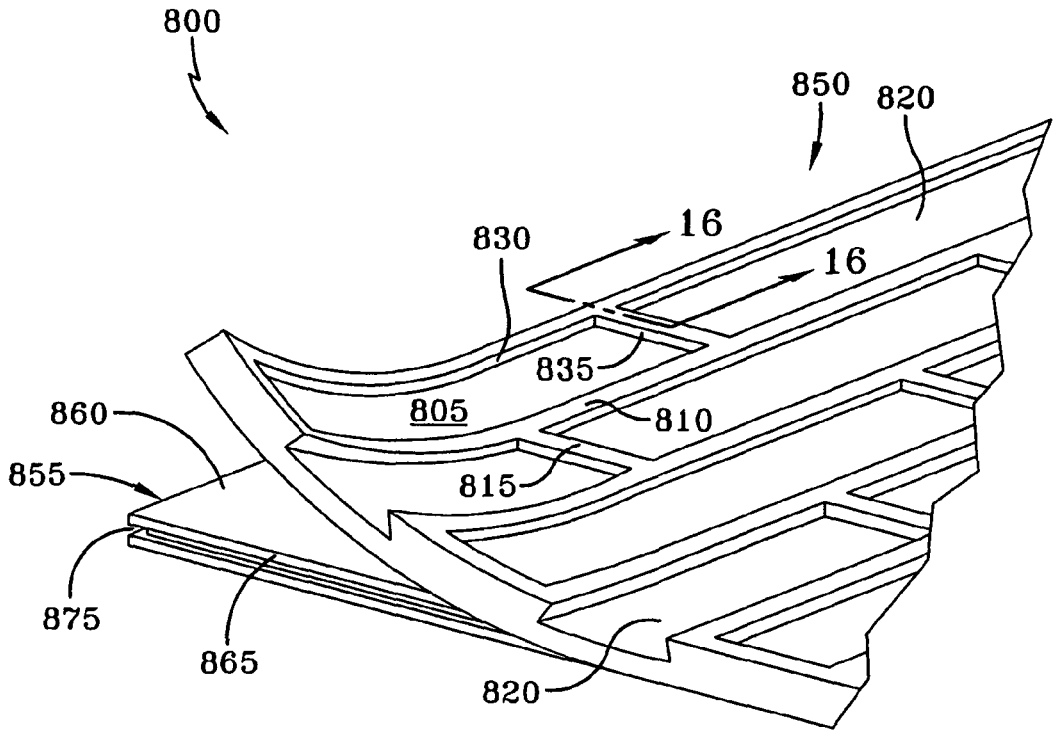
FIG. 15 is a fragmentary view in perspective showing an embodiment of the formliner of the present invention.
Figure 16:
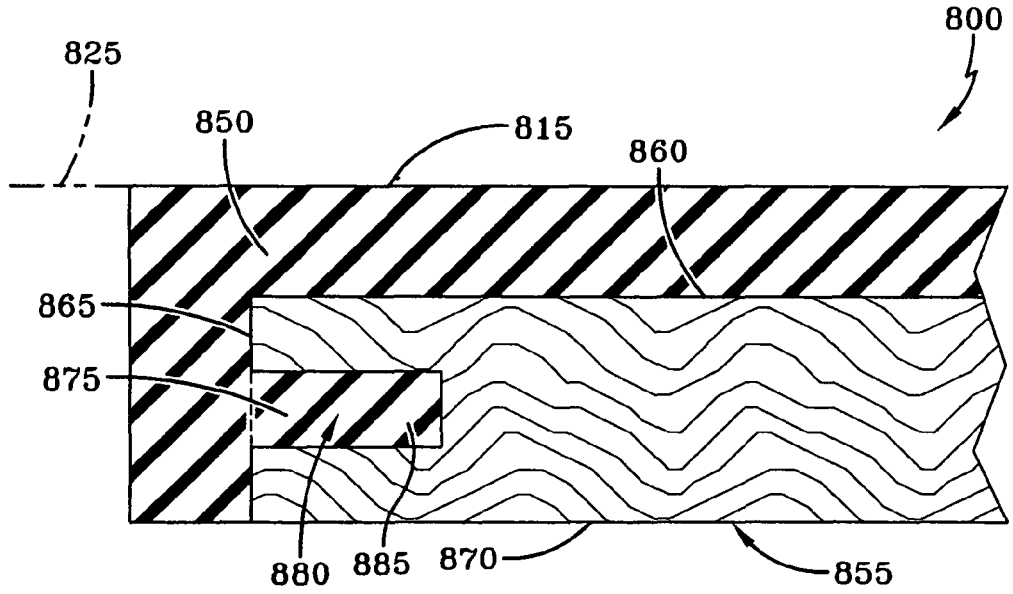
FIG. 16 is cross sectional view of the formliner of FIG. 15 taken along the line 16-16.

Another embodiment of a formliner 800 of the present invention is shown in FIG. 15 in a fragmentary view in perspective and a cross-section of the formliner of FIG. 15 taken along line 15-15 is shown in FIG. 16. A formliner 800 is shown generally in a perspective view. A main portion 850 of formliner 800 is preferably manufactured from an elastomeric material, such as rubber or any other resilient polymer of sufficient strength that it is compatible with cementitious material. In a preferred embodiment, the formliner comprises cured polymer made from liquid precursors. In a most preferred embodiment, the formliner comprises cured sulfide RTV liquid rubber made from two liquid precursors. The formliner 800 is molded and cured as known in the art.

The formliner 800 is formed with a series of recesses 805, which are separated by and defined by lateral ribs 810 and interconnecting transverse ribs 815. The recesses 805 are shown in the figures in a brick running bond configuration, the configuration in which bricks are conventionally applied to walls. Such running bond configuration is only used to illustrate the features of the present invention and is not intended to limit the scope of the invention. Any other formliner configuration known in the art may also be used with the present invention, such as, for example flemish bond, basket weave, herringbone, etc. At the base of each recess 805 is a at least substantially planar recess surface 820. The lateral ribs 810 and transverse ribs 815 extend from the at least substantially planar recess surfaces 820 to a rib plane 825.

Each of the lateral ribs 810 is provided with at least one resilient protrusion or ridge 830, on every side of the lateral ribs facing a recess 805, which extend from the lateral ribs 810 into the recesses 805. In addition, each of the transverse ribs 815 is provided with at least one resilient protrusion or ridge 835, on every side of the transverse ribs 815 facing a recess 805, which also extends from the lateral ribs 810 into the recesses 805. As known in the art, the at least one ridges 830, 835 are used engage and seal an adjacent surface of a brick (not shown) or other similar construction element, such as stone, tiles, stone slabs or other similar block elements, to prevent cementitious material, from flowing into the interior of the recess 805 and contacting the front faces of the bricks (or other element). The recess 805 has a geometry such that is able to snugly receive a brick (or other element). Preferably the structure and number of the at least one lateral ridge 830 is substantially identical to the structure and number of the at least one transverse ridge 835. Optionally, the structure and number of the at least one lateral ridge 830 is substantially identical to the structure and number of the at least one transverse ridge 835. It is preferred that there are from one to about six lateral ridges 830 present on each lateral rib 810 and that there are from one to about six transverse ridges 835 present on each transverse rib 815 for each recess 805. In a more preferred embodiment there are from one to about four lateral ridges 830 present on each lateral rib 810 and from one to about four transverse ridges 835 present on each transverse rib 815 for each recess.

The formliner comprises two separate portions, a main portion 850 and a backing 855, which adds additional structural support to the main portion 850. The backing 855 is preferably cast into the formliner 800 during manufacture as known in the art. The backing 855 has a geometry such that the backing 855 fits within the main portion 850 without interfering with the function of the recesses 805. Alternately, the backing 855 may be glued or otherwise sealed into the formliner 800 after production of the main portion 850.

Generally the backing 855 has a generally similar geometry to that of the formliner 800. As shown in the exemplary embodiment of FIG. 15 and FIG. 16, both the formliner 800 and the backing 855, which can be composed of wood or plywood, are both generally in the shape of a rectangular prism. The dimensions of the backing 855 are preferably smaller than the dimensions of the formliner 800, as the main portion 850 of the formliner 800 is positioned around the periphery of the backing 855. As an example, if the formliner is about 4' long by about 8' wide by about 1¼ inch thick, then an functional backing would be about 3' 11" wide by about 7' 11" long by about 0.75" thick. The backing 855 comprises a material selected from the group consisting of plywood, wood, metal, plastic, a non-wood composite material, and combinations thereof and is less flexible than the formliner 800. Alternately, the backing 855 can be constructed of any composite material having sufficient strength and thickness. The backing 855 is preferably comprised of plywood.

As shown in FIG. 15 and FIG. 16, the backing 855 comprises sidewalls 865, a top surface 860 and a bottom surface 870. The backing also has a notch 875. The notch 875 extends at least through at least a substantial portion of one of the sidewalls 865. The presence of the notch 875 enables the backing 855 to be held into the formliner 800 more readily than if the formliner 800 did not have a notch 875. In a preferred embodiment, the notch is present in the entire portion of all the sidewalls 865.

It is to be understood that the at least one notch 875 may be of any functional geometry, as long as it makes it less likely that the backing 855 will be dislodged from the main portion 850 during formliner 800 use and as long as the presence of the notch does not reduce the structural stability and/or the structural integrity of the formliner 800. In a preferred embodiment, the notch 875 has a substantially rectangular cross-section 880. In a preferred embodiment, the number of notches 875 is preselected from the range of from 1 to about 6. In a more preferred embodiment, there is one contiguous notch 875.

In a preferred embodiment, where the main portion 850 is a polymeric material made from liquid precursors some of polymeric precursor of material for the main portion 850 flows into at least the notch 875 during the manufacture of the formliner 800 and cures within the notch 875. During use, as the formliner 800 is manipulated, the backing 855 is less likely to be dislodged from the main portion 850 as an extension 885 of the main portion 850 extends into the backing 855.

In a preferred embodiment, the backing 855 comprises at least one layer of plywood and has a thickness in the range of about ½ inch to about 3 inches. In a more preferred embodiment, the number of layers of plywood is in the range of from 1 to about 6. In an even more preferred embodiment, the number of layers of plywood is in the range of from 1 to 2. In a most preferred embodiment, the backing 855 has a thickness of about 0.75 inch and there is one notch 875 having a cross-sectional area of about 0.125 inch. Preferably, for the wood and plywood embodiments, the ratio of the cross-sectional thickness to the thickness of the backing is substantially proportional to both the height of the notch and the depth distance of the notch. For a backing 855 which is about 3 inches thick, the notch could be as wide as about 2 inches and as deep as about 1 inch, while for a backing having a thickness of about ¾ inch, the notch could be as wide as about ¼ inch and as deep as about ½ inch without a reduction in structural stability or structural integrity. In a preferred embodiment in which a number of layers of plywood are used, there is preferably one notch 875 through all of the sidewalls 865 of a layer of plywood that is positioned furthest from the recesses 805.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A formliner apparatus comprising:

a plurality of substantially planar layers;

a plurality of lateral and transverse ribs extending in a direction away from the substantially planar layers and defining a plurality of recesses within the formliner in conjunction with the substantially planar layers, each of the plurality of ribs extending to a preselected rib plane, each recess sized to receive an individual thin brick or a fraction thereof;

at least one resilient ridge on each rib defining each recess, each at least one resilient ridge extending into an adjacent recess; and each substantially planar layer being substantially parallel with the rib plane and located a preselected variance depth distance from the rib plane, each variance depth distance for at least some of the substantially planar layers being preselected from a preselected variance depth distance range, wherein each preselected variance depth distance is not equal to every other variance depth distance.

2. The formliner of claim 1, wherein at least one rib is an exterior rib, the at least one exterior rib having an exterior side and an interior side, the interior side facing one of the recesses, the exterior side facing away from the recesses, and the formliner further comprising at least one external resilient ridge on the exterior side of the at least one exterior rib, the at least one external resilient ridge facing away from the recesses.

3. The formliner of claim 1, wherein there are a plurality of resilient ridges on each rib.

4. The formliner of claim 2, wherein there are a plurality of external resilient ridges on the exterior side of the at least one exterior rib.

5. The formliner of claim 2, the formliner further comprising:

a main portion comprising the plurality of substantially planar layers, the plurality of ribs, and the at least one resilient ridge; and a backing portion, the backing portion comprising a body, wherein at least one notch is formed in a substantial portion of the body, wherein an extension of the main portion extends into the at least one notch.

6. The formliner of claim 5, the formliner further comprising at least one pad positioned in at least two of the recesses, each at least one pad comprising a pad surface.

7. The formliner of claim 6, wherein at least one pad is positioned in each of the recesses.

8. A formliner comprising:

a plurality of substantially planar layers;

a plurality of lateral and transverse ribs extending in a direction away from the substantially planar layers and defining a plurality of recesses within the formliner in conjunction with the substantially planar layers, each of the plurality of ribs extending to a preselected rib plane, at least one exterior rib being positioned at an exterior edge of the formliner, each recess sized to receive an individual thin brick or a fraction thereof;

the at least one exterior rib having an exterior side and an interior side, the interior side facing one of the recesses, the exterior side facing away from the recesses;

at least one internal resilient ridge on each rib defining each recess, each at least one internal resilient ridge extending into an adjacent recess; and at least one external resilient ridge on the exterior side of the at least one exterior rib, the at least one external resilient ridge facing away from the recesses, an exterior ridge on a first exterior side of the formliner configured to provide a lateral formliner joint that defines a brick receiving recess in conjunction with a first adjacent formliner and a second exterior ridge of a second exterior side of the formliner configured to provide a transverse formliner joint that defines a brick receiving recess in conjunction with a second adjacent formliner.

9. The formliner of claim 8, wherein each substantially planar layer is substantially parallel with the rib plane and located a preselected variance depth distance from the rib plane, each variance depth distance for at least some of the substantially planar layers being preselected from a preselected variance depth distance range, wherein each preselected variance depth distance is not equal to every other variance depth distance.

10. The formliner of claim 9, wherein each variance depth distance is preselected for all of the substantially planar layers.

11. The formliner of claim 10, wherein each variance depth distance is substantially randomly preselected for the substantially planar layers.

12. The formliner of claim 11, wherein each variance depth distance is substantially randomly preselected from a set of discrete variance depth distances.

13. The formliner of claim 9, the formliner further comprising at least one pad positioned in at least two of the recesses, each at least one pad comprising a pad surface.

14. The formliner of claim 13, wherein each pad surface is positioned a preselected pad variance distance from each substantially planar surface, and wherein each preselected pad variance depth distance is not equal to every other pad variance depth distance.

15. The formliner of claim 13, wherein at least one pad is positioned in each of the recesses.

16. The formliner of claim 14, wherein at least one pad is positioned in each of the recesses.

17. The formliner of claim 14, wherein each pad variance depth distance is substantially randomly preselected for each of the pad surfaces.

18. The formliner of claim 8, the formliner further comprising:

a main portion comprising the plurality of substantially planar layers, the plurality of ribs, and the at least one resilient ridge; and a backing portion, the backing portion comprising a body, wherein at least one notch is formed in a substantial portion of the body, wherein an extension of the main portion extends into the at least one notch.

19. The formliner of claim 18, wherein the backing body comprises a top, a bottom, and a plurality of sidewalls and wherein the notch is formed in a substantial portion of at least one sidewall.

* * * * *